US007708569B2

(12) United States Patent
Sercu et al.

(10) Patent No.: US 7,708,569 B2
(45) **Date of Patent: *May 4, 2010**

(54) BROADSIDE-COUPLED SIGNAL PAIR CONFIGURATIONS FOR ELECTRICAL CONNECTORS

(75) Inventors: Stefaan Hendrik Jozef Sercu, Brasschaat (BE); Jan De Geest, Wetteren (BE); Jonathan E. Buck, Hershey, PA (US); Stephen B. Smith, Mechanicsburg, PA (US)

(73) Assignees: FCI Americas Technology, Inc., Carson City, NV (US); FCI, Versailles (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/924,002

(22) Filed: Oct. 25, 2007

(65) Prior Publication Data

US 2008/0102702 A1 May 1, 2008

Related U.S. Application Data

(60) Provisional application No. 60/869,292, filed on Dec. 8, 2006, provisional application No. 60/855,558, filed on Oct. 30, 2006.

(51) Int. Cl.
*H01R 13/648* (2006.01)

(52) U.S. Cl. ..... 439/108

(58) Field of Classification Search ..... 439/101, 439/108, 608

See application file for complete search history.

(56) References Cited

U.S. PATENT DOCUMENTS 3,286,220 A 11/1966 Marley et al.
3,390,369 A 6/1968 Zavertnik et al.
3,538,486 A 11/1970 Shlesinger, Jr.
3,587,028 A 6/1971 Uberbacher
3,669,054 A 6/1972 Desso et al.

(Continued)

FOREIGN PATENT DOCUMENTS

| | | |
|---|---|---|
| EP | 0273683 A2 | 7/1988 |
| EP | 1148587 B1 | 4/2002 |
| EP | 0891016 | 10/2002 |
| JP | 06-236788 | 8/1994 |
| JP | 07-114958 | 5/1995 |
| JP | 11-185886 | 6/1999 |

(Continued)

OTHER PUBLICATIONS

"Mezzanine High-Speed High-Density Connectors", Gig-Array(tm) and MEG-Array(r) Connectors, Electrical Performance Data, www.fciconnect.com, 39 pages.

(Continued)

*Primary Examiner*—Thanh-Tam T Le
(74) *Attorney, Agent, or Firm*—Woodcock Washburn LLP

(57) ABSTRACT

An electrical connector having at least four electrical contacts that form two pairs of differential signal contacts. The first and second electrical contacts may be arranged edge-to-edge along a first direction. The third electrical contact may be adjacent to, and arranged broadside-to-broadside with, the first electrical contact along a second direction substantially transverse to the first direction. The first and third electrical contacts may define one of the pairs of differential signal contacts. The fourth electrical contact may be adjacent to, and arranged broadside-to-broadside with, the second electrical contact along the second direction. The second and fourth electrical contacts may define the other pair of differential signal contacts. The two pairs of differential signal contacts may be offset from one another along the second direction.

22 Claims, 28 Drawing Sheets

U.S. PATENT DOCUMENTS

| | | | |
|---|---|---|---|
| 3,748,633 | A | 7/1973 | Lundergan |
| 4,045,105 | A | 8/1977 | Lee et al. |
| 4,076,362 | A | 2/1978 | Ichimura |
| 4,159,861 | A | 7/1979 | Anhalt |
| 4,260,212 | A | 4/1981 | Ritchie et al. |
| 4,288,139 | A | 9/1981 | Cobaugh et al. |
| 4,383,724 | A | 5/1983 | Verhoeven |
| 4,402,563 | A | 9/1983 | Sinclair |
| 4,482,937 | A | 11/1984 | Berg |
| 4,560,222 | A | 12/1985 | Dambach |
| 4,717,360 | A | 1/1988 | Czaja |
| 4,734,060 | A | 3/1988 | Kawawada et al. |
| 4,776,803 | A | 10/1988 | Pretchel et al. |
| 4,815,987 | A | 3/1989 | Kawano et al. |
| 4,867,713 | A | 9/1989 | Ozu et al. |
| 4,907,990 | A | 3/1990 | Bertho et al. |
| 4,913,664 | A | 4/1990 | Dixon |
| 4,973,271 | A | 11/1990 | Ishizuka et al. |
| 5,066,236 | A | 11/1991 | Broeksteeg |
| 5,077,893 | A | 1/1992 | Mosquera et al. |
| 5,098,311 | A | 3/1992 | Roath et al. |
| 5,163,849 | A | 11/1992 | Fogg et al. |
| 5,167,528 | A | 12/1992 | Nishiyama et al. |
| 5,174,770 | A | 12/1992 | Sasaki et al. |
| 5,192,231 | A | 3/1993 | Dolin, Jr. |
| 5,224,867 | A | 7/1993 | Ohtsuki et al. |
| 5,238,414 | A | 8/1993 | Yaegashi et al. |
| 5,254,012 | A | 10/1993 | Wang |
| 5,274,918 | A | 1/1994 | Reed |
| 5,277,624 | A | 1/1994 | Champion et al. |
| 5,286,212 | A | 2/1994 | Broeksteeg |
| 5,302,135 | A | 4/1994 | Lee |
| 5,342,211 | A | 8/1994 | Broekstagg |
| 5,356,300 | A | 10/1994 | Costello et al. |
| 5,356,301 | A | 10/1994 | Champion et al. |
| 5,357,050 | A | 10/1994 | Baran et al. |
| 5,431,578 | A | 7/1995 | Wayne |
| 5,475,922 | A | 12/1995 | Tamura et al. |
| 5,525,067 | A | 6/1996 | Gatti |
| 5,558,542 | A | 9/1996 | O'Sullivan et al. |
| 5,586,914 | A | 12/1996 | Foster, Jr. et al. |
| 5,590,463 | A | 1/1997 | Feldman et al. |
| 5,609,502 | A | 3/1997 | Thumma |
| 5,713,746 | A | 2/1998 | Olson et al. |
| 5,730,609 | A | 3/1998 | Harwath |
| 5,741,144 | A | 4/1998 | Elco et al. |
| 5,741,161 | A | 4/1998 | Cahaly et al. |
| 5,795,191 | A | 8/1998 | Preputnick et al. |
| 5,817,973 | A | 10/1998 | Elco et al. |
| 5,853,797 | A | 12/1998 | Fuchs et al. |
| 5,908,333 | A | 6/1999 | Perino et al. |
| 5,925,274 | A | 7/1999 | McKinney et al. |
| 5,961,355 | A | 10/1999 | Morlion et al. |
| 5,967,844 | A | 10/1999 | Doutrich et al. |
| 5,971,817 | A | 10/1999 | Longueville |
| 5,980,321 | A | 11/1999 | Cohen et al. |
| 5,993,259 | A | 11/1999 | Stokoe et al. |
| 6,042,389 | A | 3/2000 | Lemke et al. |
| 6,050,862 | A | 4/2000 | Ishii |
| 6,068,520 | A | 5/2000 | Winings et al. |
| 6,099,332 | A | 8/2000 | Troyan |
| 6,116,926 | A | 9/2000 | Ortega et al. |
| 6,116,965 | A | 9/2000 | Arnett et al. |
| 6,123,554 | A | 9/2000 | Ortega et al. |
| 6,125,535 | A | 10/2000 | Chiou et al. |
| 6,129,592 | A | 10/2000 | Mickievicz et al. |
| 6,139,336 | A | 10/2000 | Olson |
| 6,146,157 | A | 11/2000 | Lenoir et al. |
| 6,146,203 | A | 11/2000 | Elco et al. |
| 6,150,729 | A | 11/2000 | Ghahghahi |
| 6,171,115 | B1 | 1/2001 | Mickievicz et al. |
| 6,171,149 | B1 | 1/2001 | Van Zanten |
| 6,190,213 | B1 | 2/2001 | Reichart et al. |
| 6,212,755 | B1 | 4/2001 | Shimada et al. |
| 6,219,913 | B1 | 4/2001 | Uchiyama |
| 6,220,896 | B1 | 4/2001 | Bertoncini et al. |
| 6,227,882 | B1 | 5/2001 | Ortega et al. |
| 6,267,604 | B1 | 7/2001 | Mickievicz et al. |
| 6,269,539 | B1 | 8/2001 | Takahashi et al. |
| 6,280,209 | B1 | 8/2001 | Bassler et al. |
| 6,293,827 | B1 | 9/2001 | Stokoe et al. |
| 6,319,075 | B1 | 11/2001 | Clark et al. |
| 6,322,379 | B1 | 11/2001 | Ortega et al. |
| 6,322,393 | B1 | 11/2001 | Doutrich et al. |
| 6,328,602 | B1 | 12/2001 | Yamasaki et al. |
| 6,343,955 | B2 | 2/2002 | Billman et al. |
| 6,347,952 | B1 | 2/2002 | Hasegawa et al. |
| 6,350,134 | B1 | 2/2002 | Fogg et al. |
| 6,354,877 | B1 | 3/2002 | Shuey et al. |
| 6,358,061 | B1 | 3/2002 | Regnier |
| 6,361,366 | B1 | 3/2002 | Shuey et al. |
| 6,363,607 | B1 | 4/2002 | Chen et al. |
| 6,364,710 | B1 | 4/2002 | Billman et al. |
| 6,368,121 | B1 | 4/2002 | Ueno et al. |
| 6,371,773 | B1 | 4/2002 | Crofoot et al. |
| 6,375,478 | B1 | 4/2002 | Kikuchi |
| 6,379,188 | B1 | 4/2002 | Cohen et al. |
| 6,386,914 | B1 | 5/2002 | Collins et al. |
| 6,409,543 | B1 | 6/2002 | Astbury, Jr. et al. |
| 6,431,914 | B1 | 8/2002 | Billman |
| 6,435,913 | B1 | 8/2002 | Billman |
| 6,435,914 | B1 | 8/2002 | Billman |
| 6,461,202 | B2 | 10/2002 | Kline |
| 6,471,548 | B2 | 10/2002 | Bertoncini et al. |
| 6,482,038 | B2 | 11/2002 | Olson |
| 6,485,330 | B1 | 11/2002 | Doutrich |
| 6,494,734 | B1 | 12/2002 | Shuey et al. |
| 6,503,103 | B1 | 1/2003 | Cohen et al. |
| 6,506,081 | B2 | 1/2003 | Blanchfield et al. |
| 6,520,803 | B1 | 2/2003 | Dunn |
| 6,527,587 | B1 | 3/2003 | Ortega et al. |
| 6,537,111 | B2 | 3/2003 | Brammer et al. |
| 6,540,559 | B1 | 4/2003 | Kemmick et al. |
| 6,547,066 | B2 | 4/2003 | Koch |
| 6,547,606 | B1 | 4/2003 | Johnston et al. |
| 6,554,647 | B1 | 4/2003 | Cohen et al. |
| 5,641,141 | A1 | 6/2003 | Stoddard |
| 6,572,410 | B1 | 6/2003 | Volstorf et al. |
| 6,602,095 | B2 | 8/2003 | Astbury, Jr. et al. |
| 6,609,933 | B2 * | 8/2003 | Yamasaki ..... 439/608 |
| 6,641,411 | B1 | 11/2003 | Stoddard et al. |
| 6,652,318 | B1 | 11/2003 | Winnings et al. |
| 6,652,319 | B1 | 11/2003 | Billman |
| 6,672,907 | B2 | 1/2004 | Azuma |
| 6,692,272 | B2 * | 2/2004 | Lemke et al. ..... 439/108 |
| 6,695,627 | B2 | 2/2004 | Ortega et al. |
| 6,700,455 | B2 | 3/2004 | Tripathi et al. |
| 6,717,825 | B2 | 4/2004 | Volstorf |
| 6,762,067 | B1 | 7/2004 | Quinones et al. |
| 6,764,341 | B2 | 7/2004 | Lappoehn |
| 6,776,649 | B2 | 8/2004 | Pape et al. |
| 6,805,278 | B1 | 10/2004 | Olson et al. |
| 6,808,399 | B2 | 10/2004 | Rothermel et al. |
| 6,824,391 | B2 | 11/2004 | Mickievicz et al. |
| 6,843,686 | B2 | 1/2005 | Ohnishi et al. |
| 6,848,944 | B2 | 2/2005 | Evans |
| 6,851,974 | B2 | 2/2005 | Doutrich |
| 6,852,567 | B1 | 2/2005 | Lee et al. |
| 6,863,543 | B2 | 3/2005 | Lang et al. |
| 6,869,292 | B2 | 3/2005 | Johnescu et al. |
| 6,890,214 | B2 | 5/2005 | Brown et al. |
| 6,905,368 | B2 | 6/2005 | Mashiyama et al. |
| 6,913,490 | B2 | 7/2005 | Whiteman, Jr. et al. |
| 6,932,649 | B1 | 8/2005 | Rothermel et al. |

| | | | | |
|---|---|---|---|---|
| 6,945,796 | B2 | 9/2005 | Bassler et al. | |
| 6,953,351 | B2 | 10/2005 | Fromm et al. | |
| 6,969,268 | B2 | 11/2005 | Brunker | |
| 6,969,280 | B2 | 11/2005 | Winings et al. | |
| 6,976,886 | B2 | 12/2005 | Winings et al. | |
| 6,979,226 | B2 | 12/2005 | Otsu et al. | |
| 6,981,883 | B2 | 1/2006 | Raistrick et al. | |
| 6,988,902 | B2 | 1/2006 | Winnings et al. | |
| 6,994,569 | B2 | 2/2006 | Minich et al. | |
| 7,057,115 | B2 | 6/2006 | Clink et al. | |
| 7,097,506 | B2 | 8/2006 | Nakada | |
| 7,118,391 | B2 | 10/2006 | Minich et al. | |
| 7,131,870 | B2 | 11/2006 | Whiteman, Jr. et al. | |
| 7,157,250 | B2 | 1/2007 | Gabriel | |
| 7,182,643 | B2 | 2/2007 | Winings | |
| 7,207,807 | B2 | 4/2007 | Fogg | |
| 7,229,318 | B2 * | 6/2007 | Winings et al. | 439/608 |
| 7,320,621 | B2 | 1/2008 | Laurx | |
| 7,331,800 | B2 | 2/2008 | Winings et al. | |
| 7,407,413 | B2 * | 8/2008 | Minich | 439/608 |
| 7,422,484 | B2 | 9/2008 | Cohen et al. | |
| 7,524,209 | B2 | 4/2009 | Hull | |
| 2002/0098727 | A1 | 7/2002 | McNamara et al. | |
| 2002/0106930 | A1 | 8/2002 | Pape et al. | |
| 2003/0143894 | A1 | 7/2003 | Kline et al. | |
| 2003/0171010 | A1 | 9/2003 | Winings et al. | |
| 2003/0203665 | A1 | 10/2003 | Ohnishi et al. | |
| 2003/0220021 | A1 | 11/2003 | Whiteman, Jr. et al. | |
| 2005/0009402 | A1 | 1/2005 | Chien et al. | |
| 2005/0020109 | A1 | 1/2005 | Raistrick et al. | |
| 2005/0118869 | A1 | 6/2005 | Evans | |
| 2005/0170700 | A1 | 8/2005 | Shuey et al. | |
| 2005/0277221 | A1 | 12/2005 | Mongold | |
| 2006/0014433 | A1 | 1/2006 | Consoli | |
| 2006/0046526 | A1 | 3/2006 | Minich | |
| 2006/0121749 | A1 | 6/2006 | Fogg | |
| 2006/0192274 | A1 | 8/2006 | Lee | |
| 2007/0099455 | A1 | 5/2007 | Rothermel et al. | |
| 2007/0205774 | A1 | 9/2007 | Minich | |
| 2007/0207641 | A1 | 9/2007 | Minich | |
| 2008/0085618 | A1 | 4/2008 | Sercu | |
| 2009/0011641 | A1 | 1/2009 | Cohen et al. | |
| 2009/0191756 | A1 | 7/2009 | Hull | |

FOREIGN PATENT DOCUMENTS

| | | | |
|---|---|---|---|
| JP | 2000-003743 | | 1/2000 |
| JP | 2000-003744 | | 1/2000 |
| JP | 2000-003745 | | 1/2000 |
| JP | 2000-003746 | | 1/2000 |
| WO | WO 90/16093 | | 12/1990 |
| WO | WO 01/29931 | A1 | 4/2001 |
| WO | WO 01/39332 | A1 | 5/2001 |
| WO | WO 02/101882 | | 12/2002 |
| WO | WO2006031296 | | 3/2006 |

OTHER PUBLICATIONS

"Gig-Array(r) Connector System", www.fciconnect.com, 4 pages.

GIG-ARRAY High Speed Mezzanine Connectors 15-40 mm Board to Board, Set-up Application Specification, GS-20-016, Jun. 5, 2006, 24 pages.

In the United States Patent and Trademark Office, Non-Final Office Action in re: U.S. Appl. No.: 11/866,061 filed Oct. 2, 2007, Dated Dec. 18, 2008, 10 pages.

Perspective View of Gigarray IMLA, 1998, 1 page.

"FCI's Airmax VS® Connector System Honored at DesignCon", 2005, Heilind Electronics, Inc., http://www.heilind.com/products/fci/airmax-vs-design.asp, 1 page.

"Framatome Connector Specification", 1 page.

"MILLIPACS Connector Type A Specification", 1 page.

"B? Bandwidth and Rise Time Budgets" Module 1-8 Fiber Optic Telecommunications (E-XVI2a), http://cord.org/step_online/st1-8/stl8exvi2a.htm, 3 pages.

"Lucent Technologies' Bell Labs and FCI Demonstrate 25gb/S Data Transmission over Electrical Backplane Connectors", Feb. 1, 2005, http://www.lucent.com/press/0205/050201.bla.html, 4 pages.

"PCB-Mounted Receptacle Assemblies, 2.00 mm(0.079in) Centerlines, Right-Angle Solder-to-Board Signal Receptacle", *Metral*™, Berg Electronics, 10-6-10-7, 2 pages.

"Tyco Electronics, Z-Dok and Connector", Tyco Electronics, Jun. 23, 2003, http://Zdok.tyco.elcetronics.com, 15 pages.

4.0 UHD Connector Differential Signal Crosstalk, Reflections, 1998, p. 8-9.

AMP Z-Pack 2mm HM Connector 2 mm Centerline,Eight-Row, Right Angle Applications, Electrical Performance Report, EPR 889065, issued Sep. 1998, 59 pages.

AMP Z-Pack 2mm HM Interconnection System, 1992 and 1994© by AMP Incorporated, 6 pages.

AMP Z-Pack HM-ZD Performance at Gigabit Speeds, Report # 20GC014, May 4, 2001.

Amphenol TCS (ATCS): VHDM Connector, http://www.teradyne.com/prods/tcs/products/connectors/backplane/vhdm/index.html, 2 pages.

Amphenol TCS (ATCS):HDM® Stacker Signal Integrity, http://www.teradyne.com/prods/tcs/products/connectors/mezzanine/hdm_stacker/signint egr, 3 pages.

Amphenol TCS(ATCS): VHDM L-Series Connector, http://www.teradyne.com/prods/tcs/products/connectors/backplane/vhdm_1-series/index.html, 2006, 4 pages.

Backplane Products Overview Page, http://www.molex.com/cgi-bin/bv/molex/super_family/super_family.jsp?BV_Session ID-@, 2005-2006© Molex, 4 pages.

Communications, Data, Consumer Division Mezzanine High-Speed High-Density Connectors GIG-ARRAY® and MEG-ARRAY® electrical Performance Data, 10 pages FCI Corporation.

Fusi, M.A. et al., "Differential Signal Transmission through Backplanes and Connectors", Electronic Packaging and Production, Mar. 1996, 27-31.

Goel, R.P. et al., "AMP Z-Pack Interconnect System", 1990, AMP Incorporated, 9 pages.

HDM Separable Interface Detail, Molex®, 3 pages.

HDM/HDM *plus*, 2mm Backplane Interconnection System, Teradyne Connection Systems, ©1993, 22 pages.

HDM® HDM Plus® Connectors, http://www.teradyne.com/prods/tcs/products/connectors/backplane/hdm/index.html, 2006, 1 page.

Honda Connectors, "Honda High-Speed Backplane Connector NSP Series", Honda Tsushin Kogoyo Co., Ltd., Development Engineering Division, Tokyo , Japan, Feb. 7, 2003, 25 pages 2759 ONLY.

Hult, B., "FCI's Problem Solving Approach Changes Market, The FCI Electronics AirmMax VS®", ConnectorSupplier.com, Http://www.connectorsupplier.com/tech_updates_FCI-Airmax_archive.htm, 2006 4 pages.

Metral® 2mm High-Speed Connectors, 1000, 2000, 3000 Series, Electrical Performance Data for Differential Applications, FCI Framatome Group, 2 pages.

Metral™, "Speed and Density Extensions", FCI, Jun. 3, 1999, 25 pages.

Nadolny, J. et al., "Optimizing Connector Selection for Gigabit Signal Speeds", ECN™, Sep. 1, 2000, http://www.ecnmag.com/article/CA45245, 6 pages.

NSP, Honda The World Famous Connectors, http://www.honda-connectors.co.jp, 2 pages 2759 ONLY.

Tyco Electronics, "Champ Z-Dok Connector System", Catalog # 1309281, Issued Jan. 2002, 3 pages.

Tyco Electronics/AMP, "Z-Dok and Z-Dok and Connectors", Application Specification # 11413068, Aug. 30, 2005, Revision A, 16 pages.

VHDM Daughterboard Connectors Feature press-fit Terminations and a Non-Stubbing Seperable Interface, ©Teradyne, Inc. Connections Systems Division, Oct. 8, 1997, 46 pages.

VHDM High-Speed Differential (VHDM HSD), http://www.teradyne.com/prods/bps/vhdm/hsd.html, 6 pages.

GbX I-Trac Backplane Connector System, two pages, Printout from: http://www.molex.com/molex/family/intro.jsp?oid=-17461 &channel=Products&familyOID=- 17461&frellink=lntroduction &chanName=family&pageTitle=GbX%20l-Trac ™%20Backplane%20Connector%20System%20|%20Overview. COPYRIGHT 2005-2009.
Office Action for U.S. Appl. No. 11/866,061, dated Jul. 15, 2008.
Office Action for U.S. Appl. No. 11/866,061, dated Dec. 18, 2008.
Final Rejection for 11/866,061, dated May 28, 2009.
Notice of Allowance for 11/866,061, dated Aug. 21, 2009.
Amendment filed in 11/866,061 on Oct. 15, 2008.
Amendment filed in 11/866,061 on Mar. 18, 2009.
Amendment After Final filed in 11/866,061 on Jul. 29, 2009.
Restriction Requirement for U.S. Appl. No. 12/420,439 dated Sep. 30, 2009.
Response to Restriction for 12/420,439 filed Oct. 30, 2009.

* cited by examiner

600

800

| CROSSTALK [%] | | 2.62% |
|---|---|---|
| From | To | Risetime=50 ps (10-90%) |
| Port 3 | Port 11 | 0.58 |
| Port 3 | Port 12 | -0.11 |
| Port 3 | Port 14 | 0.19 |
| Port 3 | Port 15 | 0.73 |
| Port 3 | Port 16 | 0.27 |
| Port 3 | Port 17 | 0.21 |
| Port 3 | Port 18 | -0.27 |
| Port 3 | Port 19 | -0.08 |
| Port 3 | Port 20 | -0.18 |

| CROSSTALK [%] | | 2.80% |
|---|---|---|
| From | To | Risetime=50 ps (10-90%) |
| Port 6 | Port 11 | -0.10 |
| Port 6 | Port 12 | -0.05 |
| Port 6 | Port 13 | 0.23 |
| Port 6 | Port 14 | 0.86 |
| Port 6 | Port 15 | 0.34 |
| Port 6 | Port 17 | 0.33 |
| Port 6 | Port 18 | 1.15 |
| Port 6 | Port 19 | -0.40 |
| Port 6 | Port 20 | -0.34 |

| CROSSTALK [%] | | 3.71% |
|---|---|---|
| From | To | Risetime=50 ps (10-90%) |
| Port 3 | Port 1 | -1.28 |
| Port 3 | Port 2 | -0.10 |
| Port 3 | Port 4 | -0.23 |
| Port 3 | Port 5 | -1.24 |
| Port 3 | Port 6 | -0.25 |
| Port 3 | Port 7 | -0.22 |
| Port 3 | Port 8 | -0.17 |
| Port 3 | Port 9 | -0.08 |
| Port 3 | Port 10 | -0.14 |

| CROSSTALK [%] | | 5.46% |
|---|---|---|
| From | To | Risetime=50 ps (10-90%) |
| Port 6 | Port 1 | -0.10 |
| Port 6 | Port 2 | 0.04 |
| Port 6 | Port 3 | -0.25 |
| Port 6 | Port 4 | -1.67 |
| Port 6 | Port 5 | -0.36 |
| Port 6 | Port 7 | -0.32 |
| Port 6 | Port 8 | -2.06 |
| Port 6 | Port 9 | 0.33 |
| Port 6 | Port 10 | -0.33 |

Fig. 8

1200

| CROSSTALK [%] | | 2.65% |
|---|---|---|
| From | To | Risetime=50 ps (10-90%) |
| Port 3 | Port 11 | -0.23 |
| Port 3 | Port 12 | 0.53 |
| Port 3 | Port 14 | 0.64 |
| Port 3 | Port 15 | 0.22 |
| Port 3 | Port 16 | -0.42 |
| Port 3 | Port 17 | 0.10 |
| Port 3 | Port 18 | -0.27 |
| Port 3 | Port 19 | -0.10 |
| Port 3 | Port 20 | -0.14 |

| CROSSTALK [%] | | 3.82% |
|---|---|---|
| From | To | Risetime=50 ps (10-90%) |
| Port 6 | Port 11 | -0.18 |
| Port 6 | Port 12 | -0.04 |
| Port 6 | Port 13 | -0.34 |
| Port 6 | Port 14 | -0.36 |
| Port 6 | Port 15 | 0.84 |
| Port 6 | Port 17 | 0.68 |
| Port 6 | Port 18 | 0.42 |
| Port 6 | Port 19 | -0.78 |
| Port 6 | Port 20 | 0.18 |

| CROSSTALK [%] | | 3.52% |
|---|---|---|
| From | To | Risetime=50 ps (10-90%) |
| Port 3 | Port 1 | -0.33 |
| Port 3 | Port 2 | -0.93 |
| Port 3 | Port 4 | -0.90 |
| Port 3 | Port 5 | -0.44 |
| Port 3 | Port 6 | 0.41 |
| Port 3 | Port 7 | -0.08 |
| Port 3 | Port 8 | 0.23 |
| Port 3 | Port 9 | 0.09 |
| Port 3 | Port 10 | 0.11 |

| CROSSTALK [%] | | 4.07% |
|---|---|---|
| From | To | Risetime=50 ps (10-90%) |
| Port 6 | Port 1 | 0.19 |
| Port 6 | Port 2 | 0.03 |
| Port 6 | Port 3 | 0.41 |
| Port 6 | Port 4 | -0.39 |
| Port 6 | Port 5 | -0.94 |
| Port 6 | Port 7 | -0.56 |
| Port 6 | Port 8 | -0.65 |
| Port 6 | Port 9 | 0.68 |
| Port 6 | Port 10 | -0.22 |

Fig. 12

1600

| CROSSTALK [%] | | 0.33% |
|---|---|---|
| From | To | Risetime=50 ps (10-90%) |
| Port 3 | Port 11 | 0.14 |
| Port 3 | Port 12 | 0.02 |
| Port 3 | Port 14 | -0.03 |
| Port 3 | Port 15 | 0.07 |
| Port 3 | Port 16 | -0.02 |
| Port 3 | Port 17 | 0.03 |
| Port 3 | Port 18 | 0.01 |
| Port 3 | Port 19 | -0.01 |
| Port 3 | Port 20 | 0.00 |

| CROSSTALK [%] | | 0.40% |
|---|---|---|
| From | To | Risetime=50 ps (10-90%) |
| Port 6 | Port 11 | -0.01 |
| Port 6 | Port 12 | -0.01 |
| Port 6 | Port 13 | -0.01 |
| Port 6 | Port 14 | 0.08 |
| Port 6 | Port 15 | 0.03 |
| Port 6 | Port 17 | -0.02 |
| Port 6 | Port 18 | 0.08 |
| Port 6 | Port 19 | -0.04 |
| Port 6 | Port 20 | 0.03 |

| CROSSTALK [%] | | 1.98% |
|---|---|---|
| From | To | Risetime=50 ps (10-90%) |
| Port 3 | Port 1 | -0.92 |
| Port 3 | Port 2 | -0.04 |
| Port 3 | Port 4 | -0.05 |
| Port 3 | Port 5 | -0.92 |
| Port 3 | Port 6 | 0.01 |
| Port 3 | Port 7 | -0.02 |
| Port 3 | Port 8 | 0.01 |
| Port 3 | Port 9 | 0.01 |
| Port 3 | Port 10 | -0.00 |

| CROSSTALK [%] | | 2.19% |
|---|---|---|
| From | To | Risetime=50 ps (10-90%) |
| Port 6 | Port 1 | 0.01 |
| Port 6 | Port 2 | -0.01 |
| Port 6 | Port 3 | 0.01 |
| Port 6 | Port 4 | -0.96 |
| Port 6 | Port 5 | -0.05 |
| Port 6 | Port 7 | 0.02 |
| Port 6 | Port 8 | -0.99 |
| Port 6 | Port 9 | 0.03 |
| Port 6 | Port 10 | -0.02 |

Fig. 16

BROADSIDE-COUPLED SIGNAL PAIR CONFIGURATIONS FOR ELECTRICAL CONNECTORS

CROSS-REFERENCE TO RELATED APPLICATIONS

This application claims benefit under 35 U.S.C. § 119(e) of provisional U.S. Patent Application No. 60/855,558, filed Oct. 30, 2006, and of provisional U.S. Patent Application No. 60/869,292, filed Dec. 8, 2006, the disclosures of which are incorporated herein by reference in their entirety. This application is related by subject matter to U.S. patent application Ser. No. 11/866,061, filed Oct. 2, 2007 and entitled "Broadside-Coupled Signal Pair Configurations For Electrical Connectors," the disclosure of which is hereby incorporated by reference in its entirety.

BACKGROUND

An electrical connector may provide signal connections between electronic devices using signal contacts. The electrical connector may include a leadframe assembly that has a dielectric leadframe housing and a plurality of electrical contacts extending therethrough. Typically, the electrical contacts within a leadframe assembly are arranged into a linear array that extends along a direction along which the leadframe housing is elongated. The contacts may be arranged edge-to-edge along the direction along which the linear array extends. The electrical contacts in one or more leadframe assemblies may form differential signal pairs. A differential signal pair may consist of two contacts that carry a differential signal. The value, or amplitude, of the differential signal may be the difference between the individual voltages on each contact. The contacts that form the pair may be broadside-coupled (i.e., arranged such that the broadside of one contact faces the broadside of the other contact with which it forms the pair). Broadside or microstrip coupling is often desirable as a mechanism to control (e.g., minimize or eliminate) skew between the contacts that form the differential signal pair.

When designing a printed circuit board (PCB), circuit designers typically establish a desired differential impedance for the traces on the PCB that form differential signal pairs. Thus, it is usually desirable to maintain the same desired impedance between the differential signal contacts in the electrical connector, and to maintain a constant differential impedance profile along the lengths of the differential signal contacts from their mating ends to their mounting ends. It may further be desirable to minimize or eliminate insertion loss (i.e., a decrease in signal amplitude resulting from the insertion of the electrical connector into the signal's path). Insertion loss may be a function of the electrical connector's operating frequency. That is, insertion loss may be a greater at higher operating frequencies.

Therefore, a need exists for a high-speed electrical connector that minimizes insertion loss at higher operating frequencies while maintaining a desired differential impedance between differential signal contacts.

SUMMARY

The disclosed embodiments include an electrical connector having at least four electrical contacts that form two pairs of differential signal contacts. The first and second electrical contacts may be arranged edge-to-edge along a first direction. The third electrical contact may be adjacent to, and arranged broadside-to-broadside with, the first electrical contact along a second direction substantially transverse to the first direction. The first and third electrical contacts may define one of the pairs of differential signal contacts. The fourth electrical contact may be adjacent to, and arranged broadside-to-broadside with, the second electrical contact along the second direction. The second and fourth electrical contacts may define the other pair of differential signal contacts. The two pairs of differential signal contacts may be offset from one another along the second direction.

The electrical connector may include one or more non-air dielectrics, such as a first non-air dielectric disposed between the first and third electrical contacts that form the one pair of differential signal contacts, and a second non-air dielectric disposed between the second and fourth electrical contacts that form the other pair of differential signal contacts.

The electrical connector may further include one or more ground contacts. For example, the electrical connector may include a first ground contact adjacent to, and arranged edge-to-edge with, the first electrical contact along the first direction. The electrical connector may also include second ground contact adjacent to, and arranged edge-to-edge with, the third electrical contact along the first direction.

BRIEF DESCRIPTION OF THE DRAWINGS

FIG. 8 is a table summarizing multi-active, worst-case crosstalk exhibited by the connector shown in FIGS. 5A-5C.

FIG. 12 is a table summarizing multi-active, worst-case crosstalk exhibited by the connector shown in FIGS. 9A-9C.

FIG. 16 is a table summarizing multi-active, worst-case crosstalk exhibited by the connector shown in FIGS. 13A-13D.

DETAILED DESCRIPTION

Figure 1B:
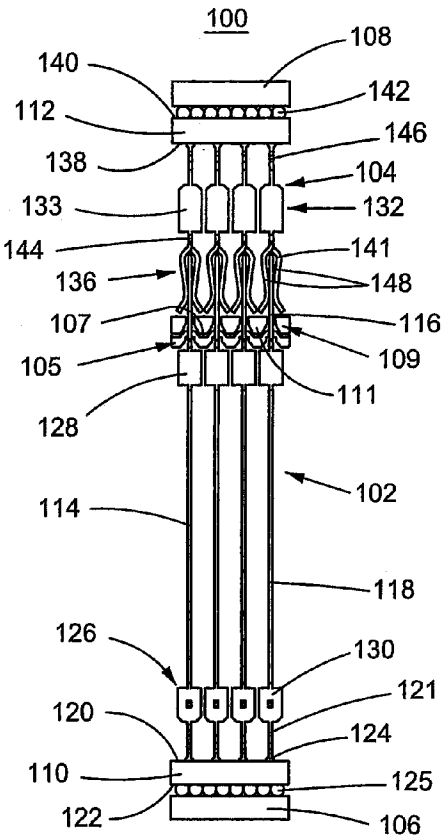
Fig. 1B PRIOR ART
FIGS. 1A and 1B depict a portion of a prior-art connector system, in isometric and side views, respectively.
Figure 1A:
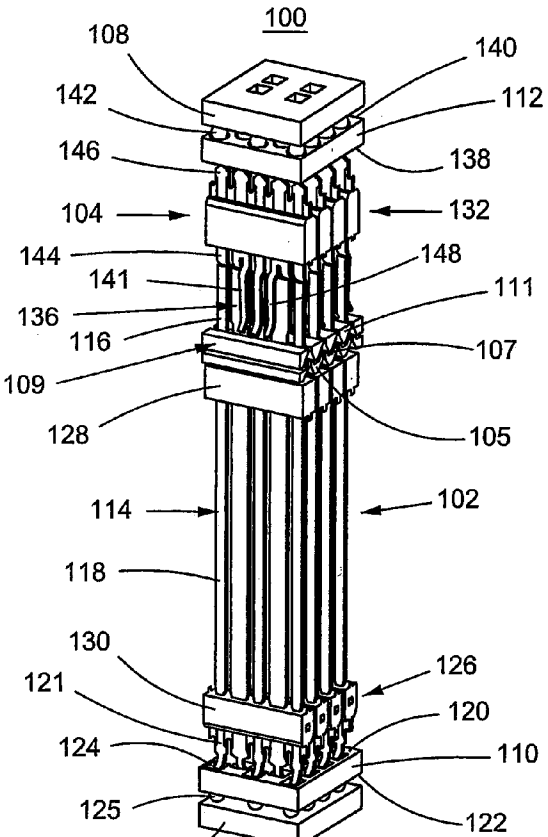
Fig. 1A PRIOR ART

FIGS. 1A and 1B depict isometric and side views, respectively, of a prior art connector system 100. The connector system 100 includes a plug connector 102 mated to a receptacle connector 104. The plug connector 102 may be mounted to a first substrate, such as a printed circuit board 106. The receptacle connector 104 may be mounted to a second substrate, such as a printed circuit board 108. The plug connector 102 and the receptacle connector 104 are shown as vertical connectors. That is, the plug connector 102 and the receptacle connector 104 each define mating planes that are generally parallel to their respective mounting planes.

The plug connector 102 may include a connector housing, a base 110, leadframe assemblies 126, and electrical contacts 114. The connector housing of the plug connector 102 may include an interface portion 105 that defines one or more grooves 107. As will be further discussed below, the grooves 107 may receive a portion of the receptacle connector 104 and, therefore, may help provide mechanical rigidity and support to the connector system 100.

Each of the leadframe assemblies 126 of the plug connector 102 may include a first leadframe housing 128 and a second leadframe housing 130. The first leadframe housing 128 and the second leadframe housing 130 may be made of a dielectric material, such as plastic, for example. The leadframe assemblies 126 may be insert molded leadframe assemblies (IMLAs) and may house a linear array of electrical contacts 114. For example, as will be further discussed below, the array of electrical contacts 114 may be arranged edge-to-edge in each lead frame assembly 126, i.e., the edges of adjacent electrical contacts 114 may face one another.

The electrical contacts 114 of the plug connector 102 may each have a cross-section that defines two opposing edges and two opposing broadsides. Each electrical contact 114 may also define at least three portions along its length. For example, as shown in FIG. 1B, each electrical contact 114 may define a mating end 116, a lead portion 118, and a terminal end 121. The mating end 116 may be blade-shaped, and may be received by a respective electrical contact 136 of the receptacle connector 104. The terminal end 121 may be "compliant" and, therefore, may be press-fit into an aperture 124 of the base 110. The terminal end 121 may electrically connect with a ball grid array (BGA) 125 on a substrate face 122 of the base 110. The lead portion 118 of the electrical contact 114 may extend from the terminal end 121 to the mating end 116.

The base 110 of the plug connector 102 may be made of a dielectric material, such as plastic, for example. The base 110 may define a plane having a connector face 120 and the substrate face 122. The plane defined by the base 110 may be generally parallel to a plane defined by the printed circuit board 106. As shown in FIG. 1A, the connector face 120 of the base 110 may define the apertures 124 that receive the terminal ends 121 of the electrical contacts 114. The substrate face 122 of the base 110 may include the BGA 125, which may electrically connect the electrical contacts 114 to the printed circuit board 106.

The receptacle connector 104 may include a connector housing, a base 112, leadframe assemblies 132, and electrical contacts 136. The connector housing of the receptacle connector 104 may include an interface portion 109 that defines one or more ridges 111. Upon mating the plug connector 102 and the receptacle connector 104, the ridges 111 on the connector housing of the receptacle connector 104 may engage with the grooves 107 on the connector housing of the plug connector 102. Thus, as noted above, the grooves 107 and the ridges 111 may provide mechanical rigidity and support to the connector system 100.

Each of the leadframe assemblies 132 of the receptacle connector 104 may include a leadframe housing 133. The leadframe housing 133 may be made of a dielectric material, such as plastic, for example. Each of the leadframe assemblies 132 may be an insert molded leadframe assembly (IMLAs) and may house a linear array of electrical contacts 136. For example, the array of electrical contacts 136 may be arranged edge-to-edge in the leadframe assembly 132, i.e., the edges of adjacent electrical contacts 136 may face one another.

Like the electrical contacts 114, the electrical contacts 136 of the receptacle connector 104 may have a cross-section that defines two opposing edges and two opposing broadsides. Each electrical contact 136 may define at least three portions along its length. For example, as shown in FIG. 1B, each electrical contact 136 may define a mating end 141, a lead portion 144, and a terminal end 146. The mating end 141 of the electrical contact 136 may be any receptacle for receiving a male contact, such as the blade-shaped mating end 116 of the electrical contact 114. For example, the mating end 141 may include at least two-opposing tines 148 that define a slot therebetween. The slot of the mating end 141 may receive the blade-shaped mating end 116 of the electrical contacts 114. The width of the slot (i.e., the distance between the opposing tines 148) may be smaller than the thickness of the blade-shaped mating end 116. Thus, the opposing tines 148 may exert a force on each side of the blade-shaped mating end 116, thereby retaining the mating end 116 of the of the electrical contact 114 in the mating end 141 of the electrical contact 136. Alternatively, as shown in FIG. 1A, the mating end 141 may include a single tine 148 that is configured to make contact with one side of the blade-shaped mating end 116.

The terminal end 146 of the electrical contact 136 may be "compliant" and, therefore, may be press-fit into an aperture (not shown) of the base 112. The terminal end 146 may electrically connect with a ball grid array (BGA) 142 on a substrate face 140 of the base 112. The lead portion 144 of each electrical contact 136 may extend from the terminal end 146 to the mating end 141.

The base 112 of the receptacle connector 104 may be made of a dielectric material, such as plastic, for example. The base 112 may define a plane having a connector face 138 and the substrate face 140. The plane defined by the base 112 may be generally parallel to a plane defined by the printed circuit board 108. The connector face 138 may define apertures (not shown) for receiving the terminal ends 146 of electrical contacts 136. Although the apertures of the base 112 are not shown in FIGS. 1A and 1B, the apertures in the connector face 138 of the base 112 may be the same or similar to the apertures 124 in the connector face 120 of the base 110. The substrate face 140 may include the BGA 142, which may electrically connect the electrical contacts 136 to the printed circuit board 108.

Figure 1C:
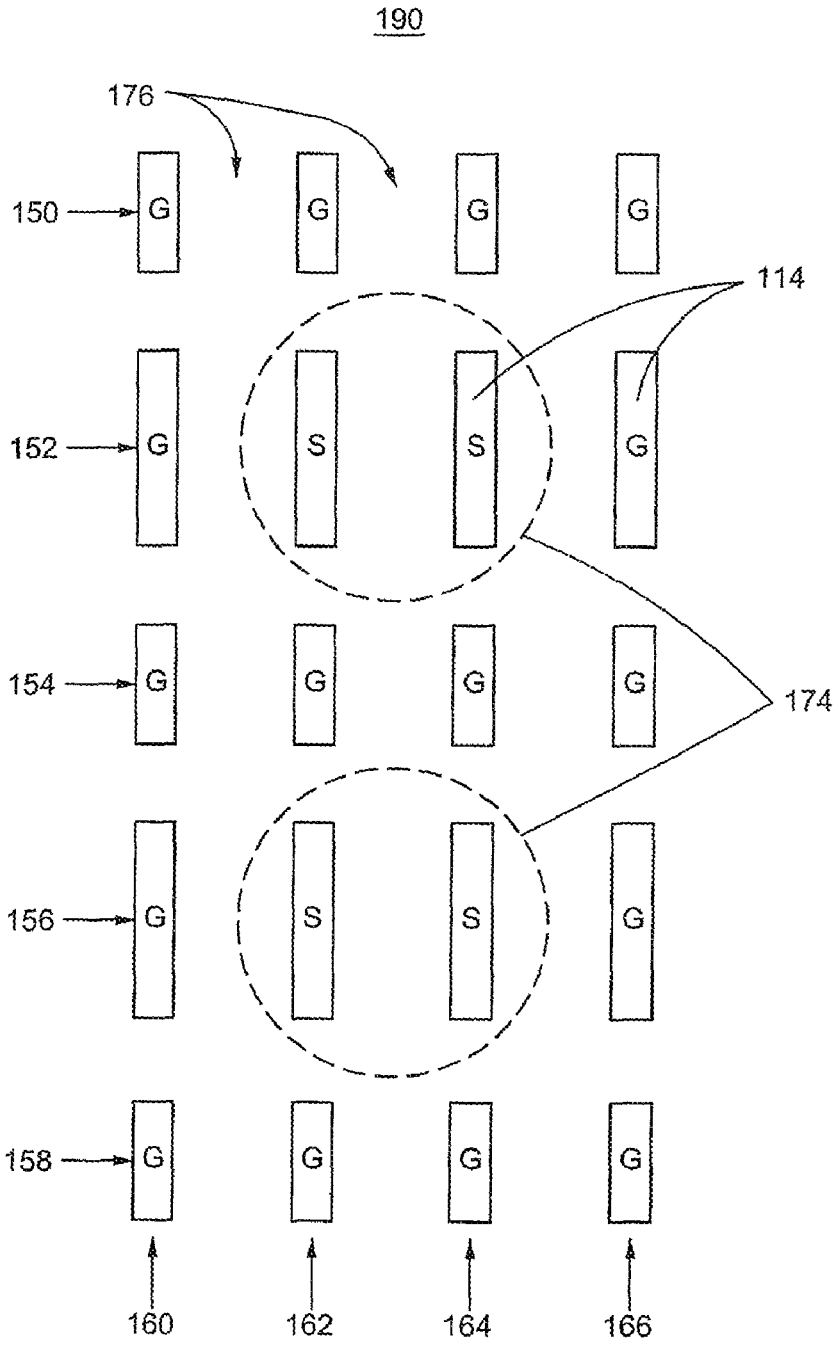
Fig. 1C PRIOR ART
FIG. 1C depicts a contact arrangement of the prior-art connector system shown in FIGS. 1A and 1B.

FIG. 1C depicts a contact arrangement 190, viewed from the face of the plug connector 102, in which the electrical contacts 114 are arranged in linear arrays. As shown in FIG. 1C, the electrical contacts 114 may be arranged in a 5×4 array, though it will be appreciated that the plug connector 102 may include any number of the electrical contacts 114 arranged in various configurations. As shown, the plug connector 102 may include contact rows 150, 152, 154, 156, 158 and contact columns 160, 162, 164, 166.

As noted above, each of the electrical contacts 114 may have a cross-section that defines two opposing edges and two opposing broadsides. The electrical contacts 114 may be arranged edge-to-edge along each of the columns 160, 162, 164, 166. In addition, the electrical contacts 114 may be arranged broadside-to-broadside along each of the rows 150, 152, 154, 156, 158. As shown in FIG. 1C, the broadsides of the electrical contacts 114 in the rows 150, 154, 158 may be smaller than the broadsides of the electrical contacts 114 in the rows 152, 156. Each of the electrical contacts 114 may be surrounded on all sides by a dielectric 176, which may be air.

The electrical contacts 114 in the plug connector 102 may include ground contacts G and signal contacts S. As shown in FIG. 1C, the rows 150, 154, 158 of the plug connector 102 may include all ground contacts G. The rows 152, 156 of the plug connector 102 may include both ground contacts G and signal contacts S. For example, the electrical contacts 114 in the rows 152, 156 may be arranged in a G-S-S-G pattern. As noted above, the electrical contacts 114 may be arranged broadside-to-broadside along each of the rows 150, 152, 154, 156, 158. Accordingly, adjacent signal contacts S in rows 152, 156 may form broadside coupled differential signal pairs, such as the differential signal pairs 174 shown in FIG. 1C.

Figure 2B:
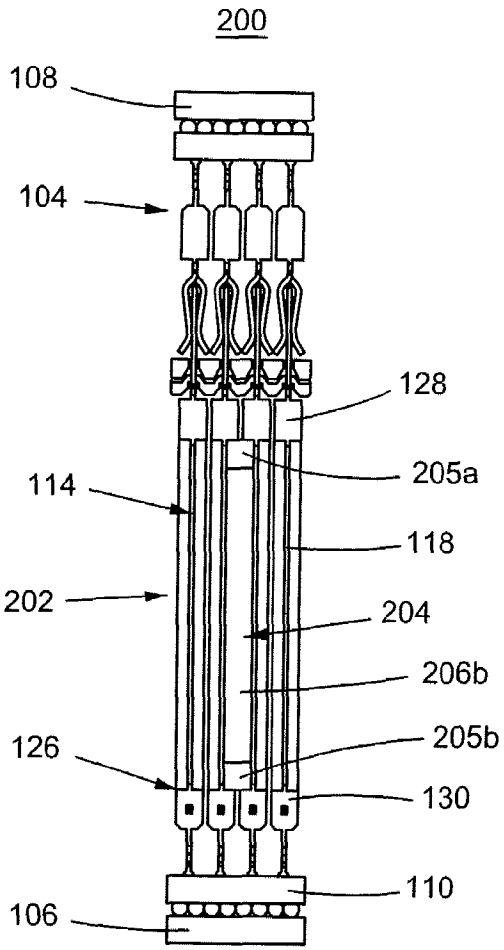
FIGS. 2A and 2B depict a portion of a connector system, in isometric and side views, respectively, according to an embodiment.
Figure 2A:
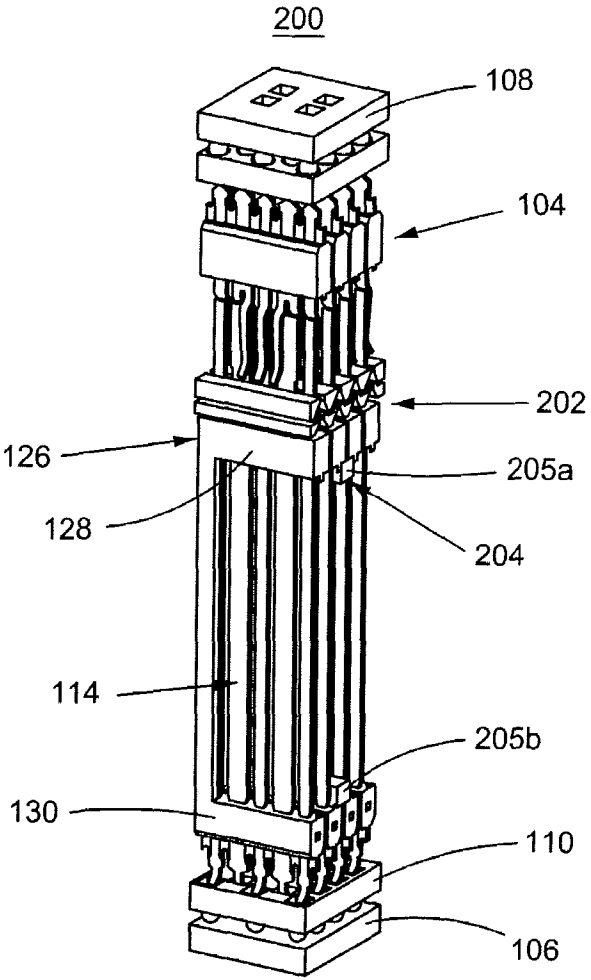

FIGS. 2A and 2B depict isometric and side views, respectively, of a connector system 200 according to an embodiment. The connector system 200 may include a plug connector 202 mated to the receptacle connector 104. The plug connector 202 may be mounted to the printed circuit board 106. The receptacle connector 104 may be mounted to the printed circuit board 108. The plug connector 202 and the receptacle connector 104 are shown as vertical connectors. However, it will be appreciated that either or both of the plug connector 202 and the receptacle connector 104 may be right-angle connectors in alternative embodiments.

The plug connector 202 may include the base 110, leadframe assemblies 126, and electrical contacts 114. As shown in FIG. 2B, the plug connector 202 may further include a non-air dielectric, such as a dielectric material 204, positioned between adjacent leadframe assemblies 126. In particular, the dielectric material 204 may be positioned between the adjacent leadframe assemblies that house one or more signal contacts S. The dielectric material 204 may be made from any suitable material, such as plastic, for example. The dielectric material 204 may be molded as part of the leadframe assemblies 126. Alternatively, the dielectric material 204 may be molded independent of the leadframe assemblies 126 and subsequently inserted therebetween.

Figure 2C:
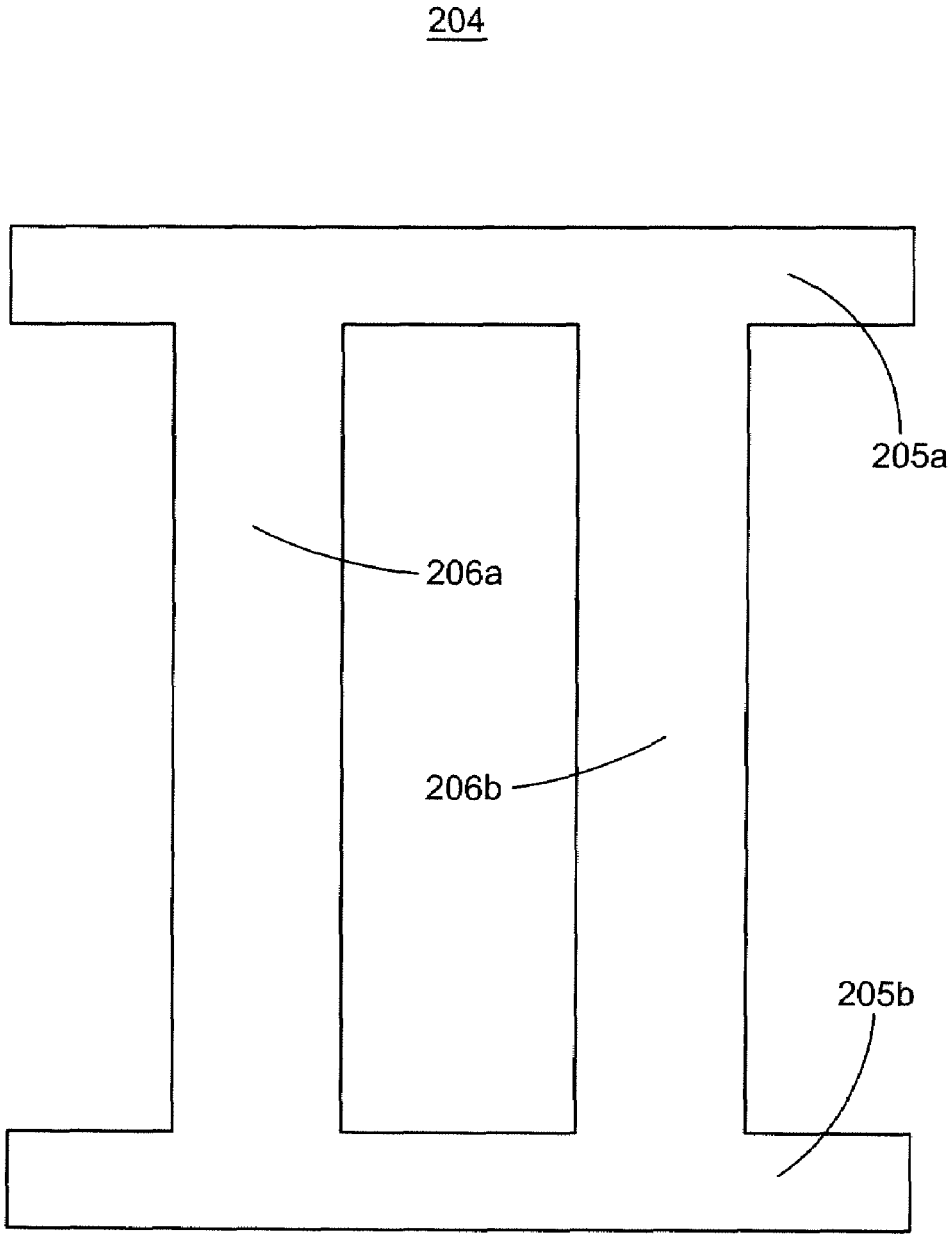
FIG. 2C depicts an example dielectric material that may be disposed between leadframe assemblies of a plug connector shown in FIGS. 2A and 2B.

FIG. 2C depicts a side view of the dielectric material 204. As shown in FIG. 2C, the dielectric material 204 may include header portions 205*a*, 205*b*, that extend substantially parallel to one another. The dielectric material may further include interconnecting portions 206*a*, 206*b* that extend substantially parallel to one another and substantially perpendicular to the header portions 205*a*, 205*b*. The interconnecting portions 206*a*, 206*b* may connect the header portion 205*a* to the header portion 205*b*.

As noted above with respect to FIGS. 2A and 2B, the dielectric material 204 may be disposed between adjacent leadframe assemblies 126 having signal contacts S (i.e., the inner leadframe assemblies 126 shown in FIGS. 2A and 2B). More specifically, the header portion 205*a* of the dielectric material 204 may be adjacent to the first leadframe housing 128 and may extend along a length thereof. The header portion 205*b* of the dielectric material 204 may be adjacent to the second leadframe housing 130 and may extend along a length thereof. Thus, the header portions 205*a*, 205*b* may be disposed adjacent to at least a portion of each electrical contact 114 in the inner leadframe assemblies 126. The interconnecting portions 206*a*, 206*b* of the dielectric material 204 may extend substantially parallel to the electrical contacts 114 in the inner leadframe assemblies 126. In particular, as will be further discussed below, the interconnecting portions 206*a*, 206*b* may extend along the lengths of each signal contact housed in the inner leadframe assemblies 126.

Figure 2D:
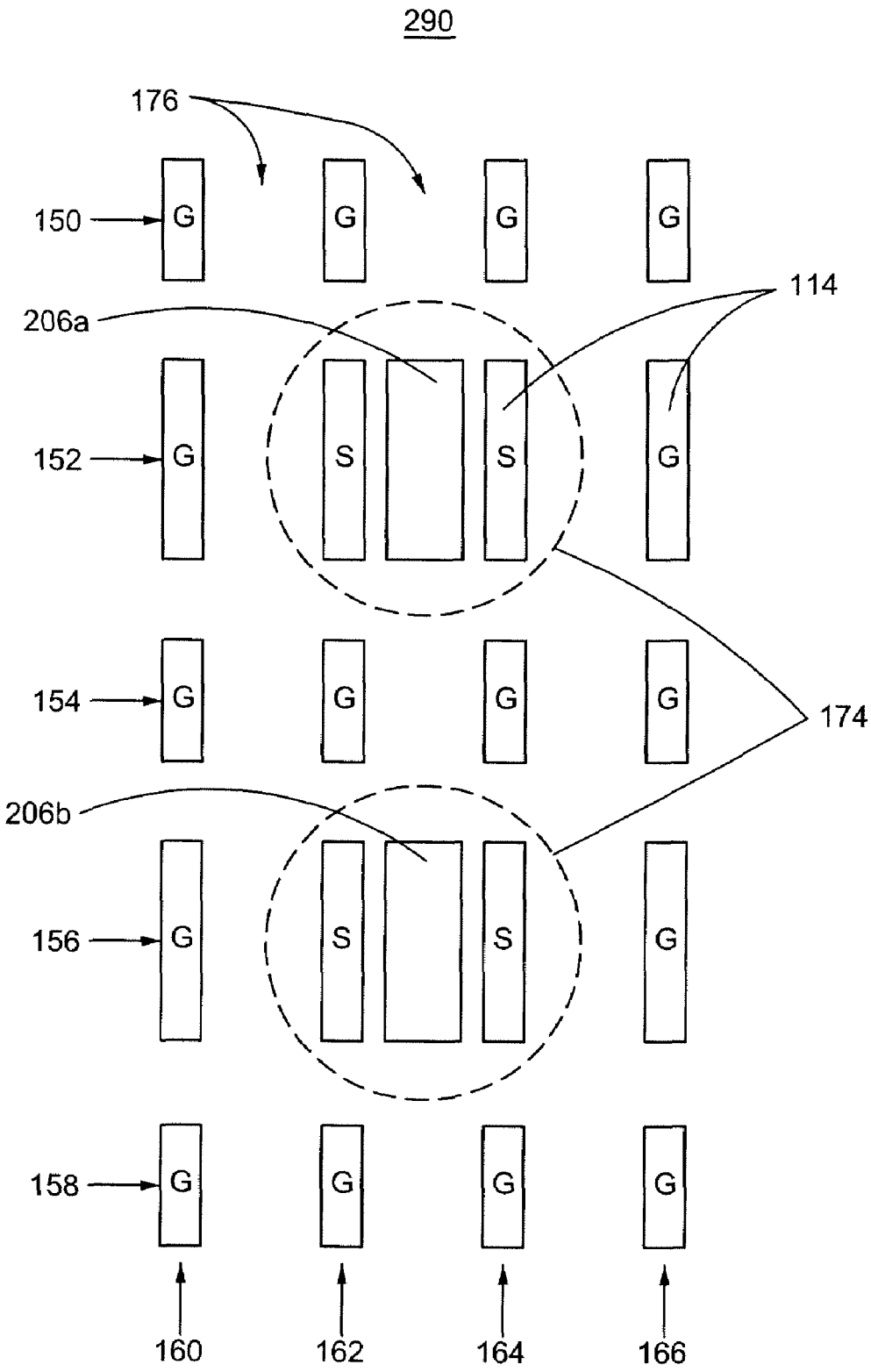
FIG. 2D depicts an example contact arrangement of the plug connector shown in FIGS. 2A and 2B.

FIG. 2D depicts a contact arrangement 290, viewed from the face of the plug connector 202, that includes the linear arrays of electrical contacts 114 and a portion of the dielectric material 204. Like the contact arrangement depicted in FIG. 1C, the electrical contacts 114 may be arranged in a 5×4 array and may define contact rows 150, 152, 154, 156, 158 and contact columns 160, 162, 164, 166. The electrical contacts 114 in the plug connector 202 may have a cross-section that defines two opposing edges and two opposing broadsides. The electrical contacts 114 may be arranged edge-to-edge along each of the columns 160, 162, 164, 166. In addition, the electrical contacts 114 may be arranged broadside-to-broadside along each of the rows 150, 152, 154, 156, 158. The broadsides of the electrical contacts 114 in the rows 150, 154, 158 may be smaller than the broadsides of the electrical contacts 114 in the rows 152, 156.

The electrical contacts 114 in the plug connector 202 may also include ground contacts G and signal contacts S. The rows 150, 154, 158 of the plug connector 202 may include all ground contacts G, and the rows 152, 156 may include both ground contacts G and signal contacts S. For example, the electrical contacts 114 in the rows 152, 156 may be arranged in a G-S-S-G pattern. The electrical contacts 114 may be arranged broadside-to-broadside along each of the rows 150, 152, 154, 156, 158. Accordingly, adjacent signal contacts S in rows 152, 156 may form broadside coupled differential signal pairs 174.

As shown in FIG. 2D, the interconnecting portions 206*a*, 206*b* of the dielectric material 204 may define a generally rectangular cross-section and may be positioned between adjacent signal contacts S in the columns 162, 164. That is, the interconnecting portions 206*a*, 206*b* may be positioned between the signal contacts S of each broadside-coupled differential signal pair 174 in the plug connector 202. In addition, each of the electrical contacts 114 may be surrounded on all sides by the dielectric 176, which may be different than the dielectric material 204 disposed between the broadside-coupled differential signal pairs 174.

As further shown in FIG. 2D, the interconnecting portions 206*a*, 206*b* may extend a greater distance than each of the electrical contacts 114 in the direction of the rows 150, 152, 154, 156, 158 (i.e., the interconnecting portions 206*a*, 206*b* may be wider than the electrical contacts 114), though it will be appreciated that the widths of the interconnecting portions 206*a*, 206*b* may be equal to or less than the widths of the electrical contacts 114 in other embodiments. In addition, the interconnecting portions 206*a*, 206*b* may extend substantially the same distance as each of the electrical contacts 114 in the direction of the contact columns 160, 162, 164, 166 (i.e., the height of each of the interconnecting portions 206*a*, 206*b* may be substantially the same as the heights of the electrical contacts 114 in the contact rows 152, 156), though it will be appreciated that the heights of the interconnecting portions 206*a*, 206*b* may be greater than or less than the heights of the electrical contacts 114 in other embodiments.

Figure 3B:
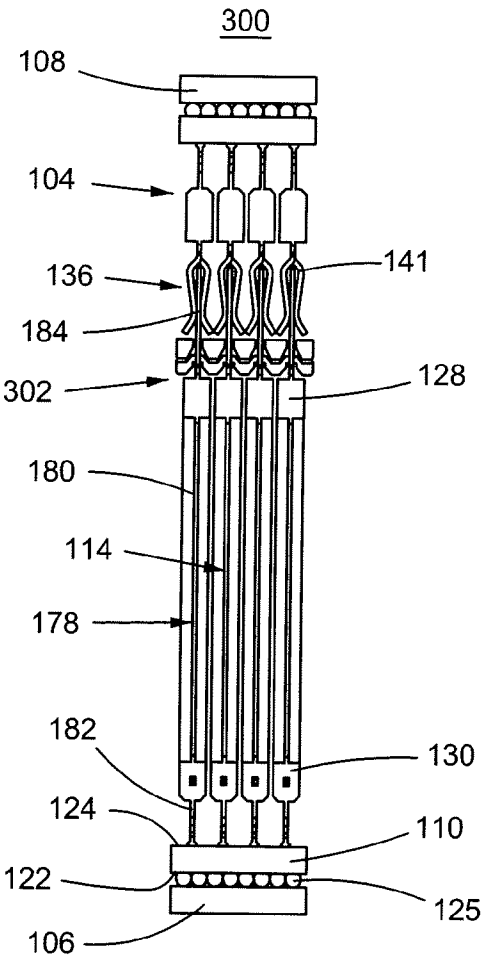
FIGS. 3A and 3B depict a portion of a connector system, in isometric and side views, respectively, according to another embodiment.
Figure 3A:
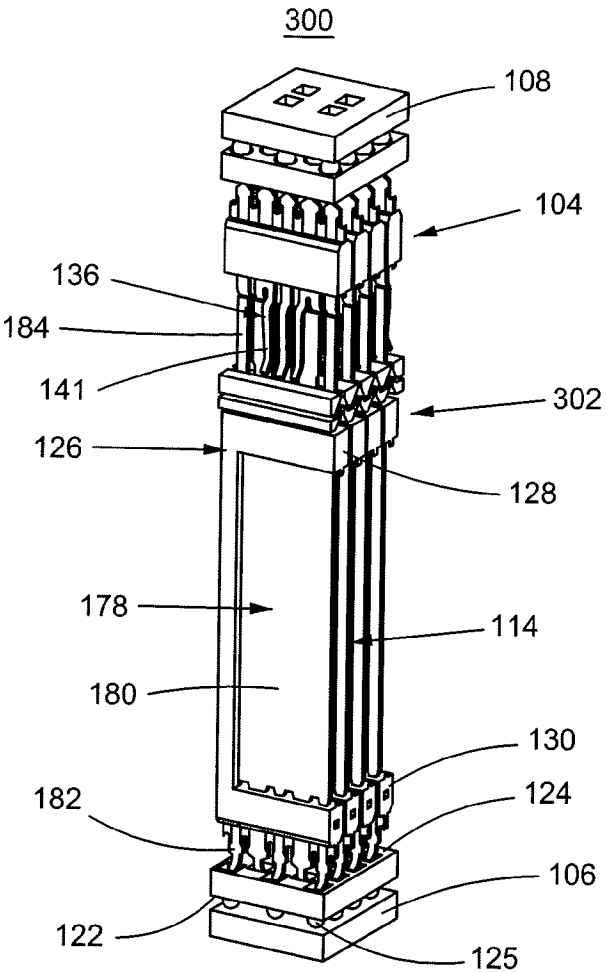

FIGS. 3A and 3B depict isometric and side views, respectively, of a connector system 300 according to another embodiment. The connector system 300 includes a plug connector 302 mated to the receptacle connector 104. The plug connector 302 may be mounted to the printed circuit board 106. The receptacle connector 104 may be mounted to the printed circuit board 108. The plug connector 302 and the receptacle connector 104 are shown as vertical connectors. However, it will be appreciated that either or both of the plug connector 302 and the receptacle connector 104 may be right-angle connectors in alternative embodiments.

The plug connector 302 may include the base 110, leadframe assemblies 126, and electrical contacts 114. As shown in FIG. 3A, the plug connector 302 may further include a commoned ground plate 178 housed in at least one of the leadframe assemblies 126. The commoned ground plate 178 may be a continuous, electrically conductive sheet that extends along an entire contact column and that is brought to ground, thereby shielding all electrical contacts 114 adjacent to the commoned ground plate 178. The commoned ground plate 178 may include a plate portion 180, terminal ends 182, and mating interfaces 184.

More specifically, the plate portion 180 of the commoned ground plate 178 may be housed within the leadframe assembly 126, and may extend from the terminal ends 182 to the mating interfaces 184. As shown in FIG. 3A, the commoned ground plate 178 may include terminal ends 182 extending from the plate portion 180, and extending from the second leadframe housing 130 of the leadframe assembly 126. The terminal ends 182 may be compliant and may, therefore, be press-fit into the apertures 124 of the base 110. The terminal ends 182 of the commoned ground plate 178 may electrically connect with the BGA 125 on the bottom side 122 of the base 110.

The commoned ground plate 178 may also include mating interfaces 184 extending from the plate portion 180, and extending above the first leadframe housing 128 of the lead frame assembly 126. The mating interfaces 184 may be blade-shaped, and may be received by the respective mating ends 141 of the electrical contacts 136.

Figure 3C:
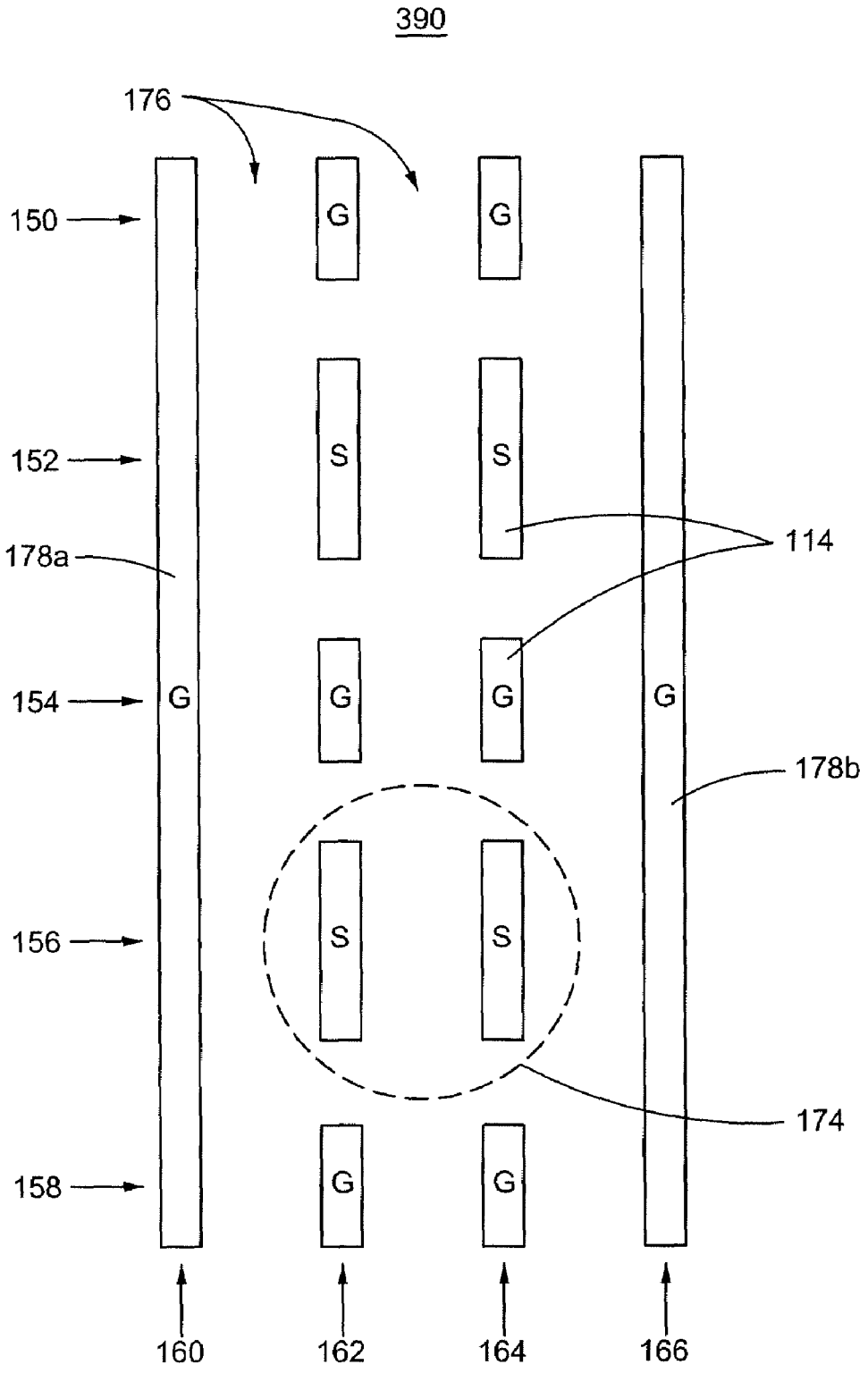
FIG. 3C depicts an example contact arrangement of a plug connector shown in FIGS. 3A and 3B.

FIG. 3C depicts a contact arrangement 390, viewed from the face of the plug connector 302, that includes linear arrays of electrical contacts 114 and commoned ground plates 178*a*, 178*b*. The electrical contacts 114 and the commoned ground plates 178*a*, 178*b* may be arranged in a 5×4 array and may define contact rows 150, 152, 154, 156, 158 and contact columns 160, 162, 164, 166. Like the contact arrangement depicted in FIG. 1C, the electrical contacts 114 in the plug connector 302 may have a cross-section that defines two opposing edges and two opposing broadsides. The electrical contacts 114 may be arranged edge-to-edge along each of the columns 162, 164. In addition, the electrical contacts 114 may be arranged broadside-to-broadside along each of the rows 150, 152, 154, 156, 158. The broadsides of the electrical contacts 114 in the rows 150, 154, 158 may be smaller than the broadsides of the electrical contacts 114 in the rows 152, 156.

The commoned ground plates 178*a*, 178*b* may be positioned adjacent to the contact columns 162, 164, respectively. Thus, as shown in FIG. 3C, the commoned ground plates 178*a*, 178*c* may replace the ground contacts G in the contact columns 160, 166 shown in FIG. 1C.

The electrical contacts 114 in the plug connector 302 may include ground contacts G and signal contacts S. The rows 150, 154, 158 of the plug connector 302 may include all ground contacts G, and the rows 152, 156 may include both ground contacts G and signal contacts S. For example, the commoned ground plates 178*a*, 178*b* and the electrical contacts 114 in the rows 152, 156 may be arranged in a G-S-S-G pattern. The electrical contacts 114 may be arranged broadside-to-broadside along each of the rows 150, 152, 154, 156, 158. Accordingly, adjacent signal contacts S in rows 152, 156 may form broadside coupled differential signal pairs 174.

The commoned ground plates 178*a*, 178*b* may each have a cross-section that is generally rectangular in shape. As shown in FIG. 3C, the commoned ground plates 178*a*, 178*b* may each extend substantially the entire length of the contact columns 160, 162, 164, 166. The commoned ground plates 178*a*, 178*b* may also extend substantially the same distance as each of the electrical contacts 114 in the direction of the contact rows (i.e., each of the commoned ground plates 178*a*, 178*b* may have substantially the same width as the electrical contacts 114), though it will be appreciated that the widths of the of the commoned ground plates 178*a*, 178*b* may be less than or greater than the widths of the electrical contacts 114 in other embodiments. The electrical contacts 114 and the commoned ground plates 178*a*, 178*b* may be surrounded on all sides by the dielectric 176.

Figure 4B:
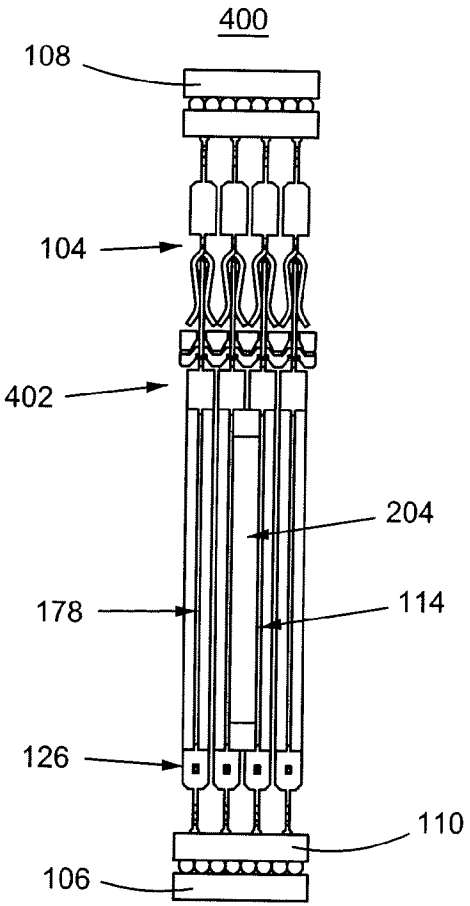
FIGS. 4A and 4B depict a portion of a connector system, in isometric and side views, respectively, according to another embodiment.
Figure 4A:
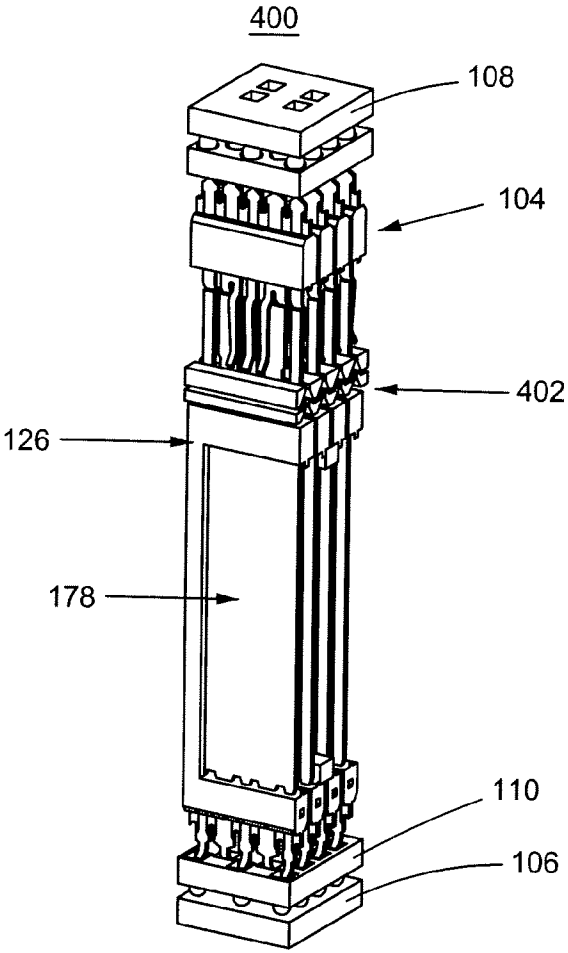

FIGS. 4A and 4B depict isometric and side views, respectively, of a connector system 400 according to another embodiment. The connector system 400 may include a plug connector 402 mated to the receptacle connector 104. The plug connector 402 may be mounted to the printed circuit board 106. The receptacle connector 104 may be mounted to the printed circuit board 108. The plug connector 402 and the receptacle connector 104 are shown as vertical connectors. However, either or both of the plug connector 402 and the receptacle connector 104 may be right-angle connectors in alternative embodiments. The plug connector 402 may include the base 110, the leadframe assemblies 126, the electrical contacts 114, the commoned ground plates 178*a*, 178*b*, and the dielectric material 204.

Figure 4C:
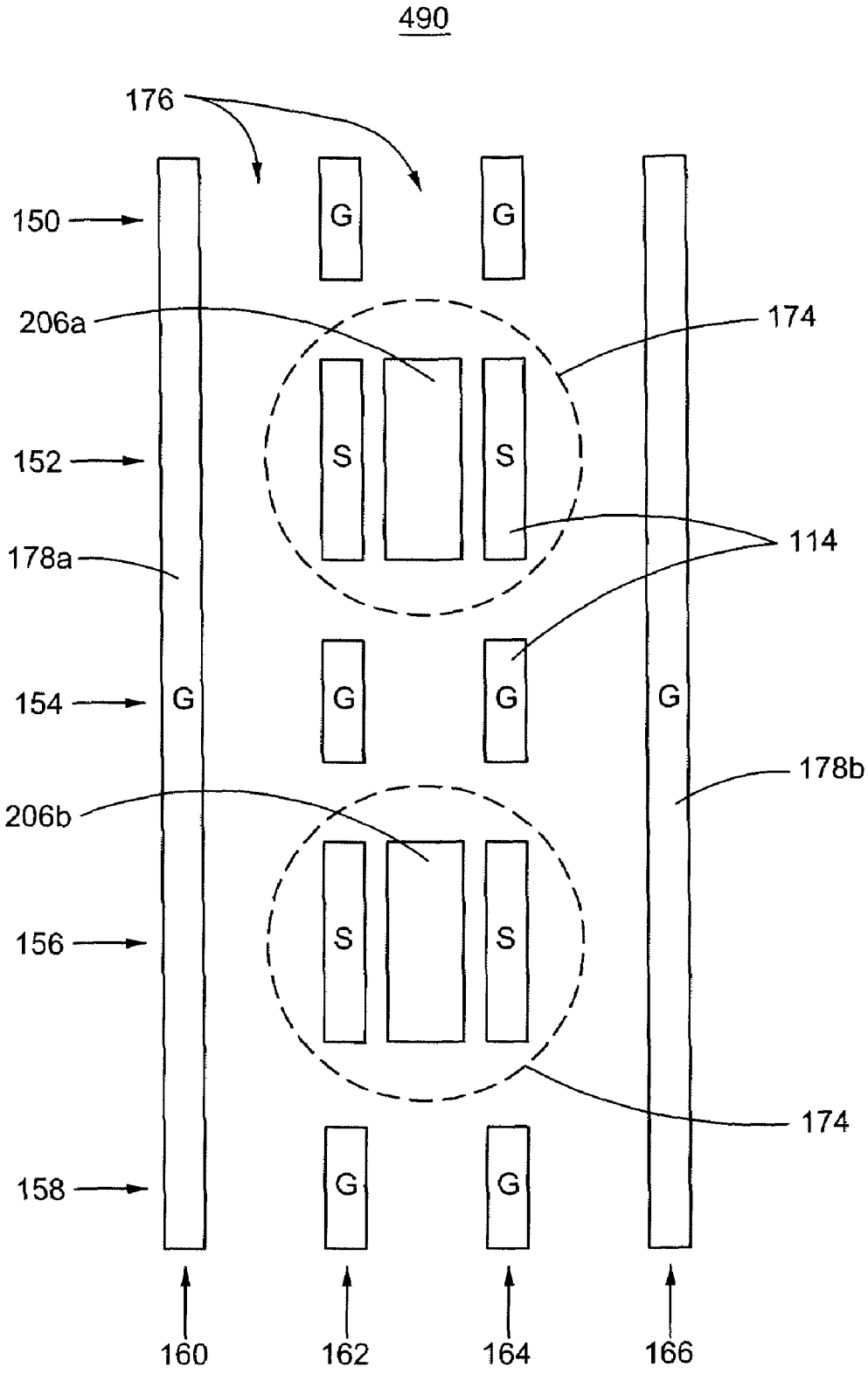
FIG. 4C depicts an example contact arrangement of a plug connector shown in FIGS. 4A and 4B.

FIG. 4C depicts a contact arrangement 490, viewed from the face of the plug connector 402, that includes linear arrays of electrical contacts 114, the commoned ground plates 178*a*, 178*b* and the dielectric material 204. As shown in FIG. 4C, the interconnecting portions 206*a*, 206*b* of the dielectric material 204 may define a generally rectangular cross-section and may be positioned between the signal contacts S in the contact columns 162, 164. That is, the interconnecting portions 206*a*, 206*b* may be positioned between the broadside-coupled differential signal pairs 174 in the contact columns 162, 164. In addition, each of the electrical contacts 114 and the commoned ground plates 178*a*, 178*b* may be surrounded on all sides by the dielectric 176, which may be different than the dielectric material 204 disposed between the broadside-coupled differential signal pairs 174.

As further shown in FIG. 4C, the commoned ground plates 178*a*, 178*b* may be positioned adjacent to the contact columns 162, 164, respectively. Thus, the commoned ground plates 178*a*, 178*b* may replace the ground contacts G in the contact columns 160, 166 shown in FIG. 1C. The commoned ground plates 178*a*, 178*b* may each have a cross-section that is generally rectangular in shape. As shown in FIG. 4C, the commoned ground plates 178*a*, 178*b* may each extend substantially the entire length of the contact columns 160, 162, 164, 166. The commoned ground plates 178*a*, 178*b* may also extend substantially the same distance as each of the electrical contacts 114 in the direction of the contact rows (i.e., each of the commoned ground plates 178*a*, 178*b* may have the same width as the electrical contacts 114), though it will be appreciated that the widths of the of the commoned ground plates 178*a*, 178*b* may be less than or greater than the widths of the electrical contacts 114 in other embodiments.

It has also been found that the foregoing embodiments break up the coupling wave that moves up the connector causing a dB "suck out" about the 4 GHz region. An object of the plastic is to change the impedance slightly between signal and ground to minimize the coupling wave. The ground plane is to minimize the signal pair coupling to the ground individual pin edge and to provide a continuous ground plane.

Figure 5A:
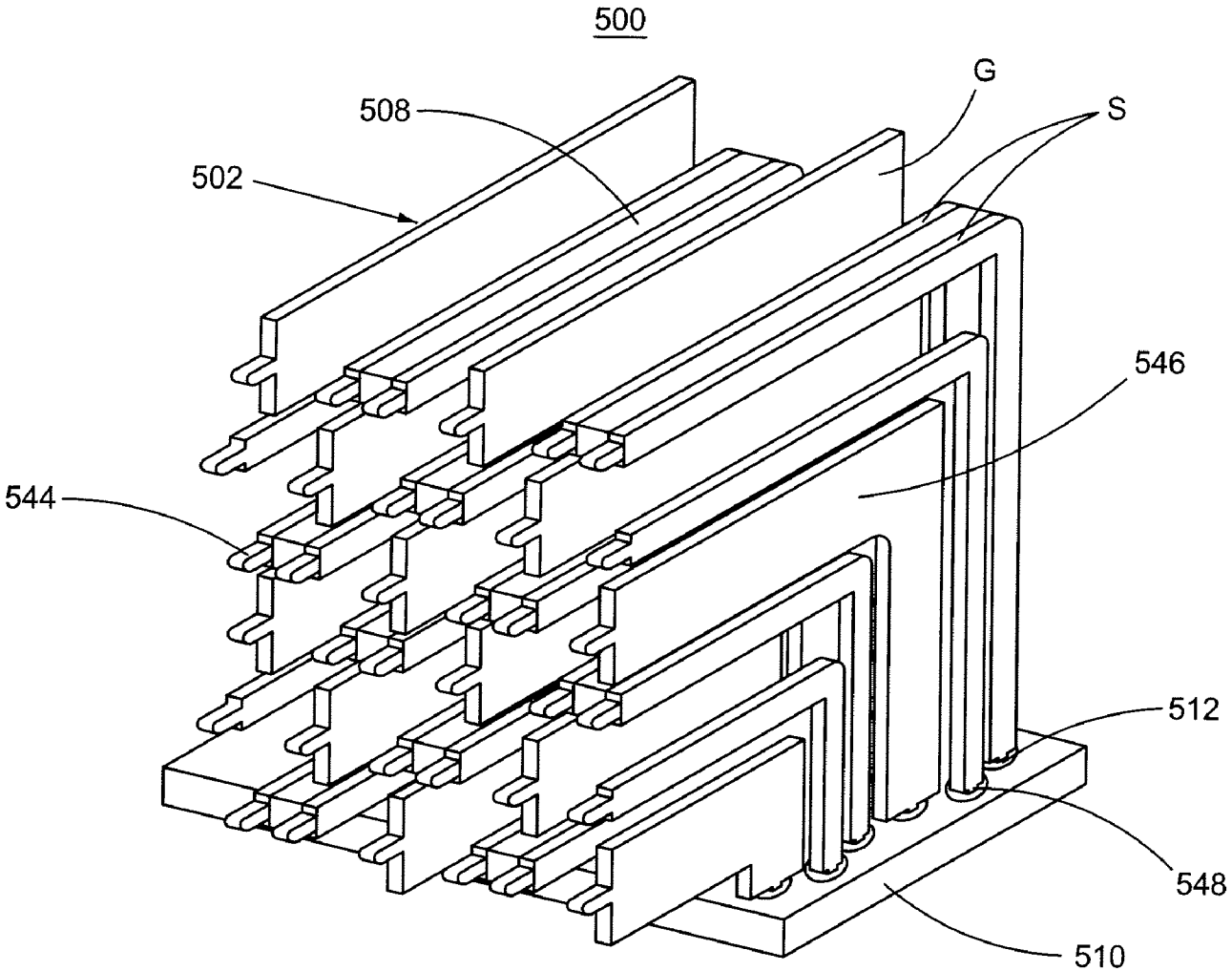
FIGS. 5A and 5B depict a portion of a connector, in isometric and rear views, respectively, according to another embodiment.
Figure 5B:
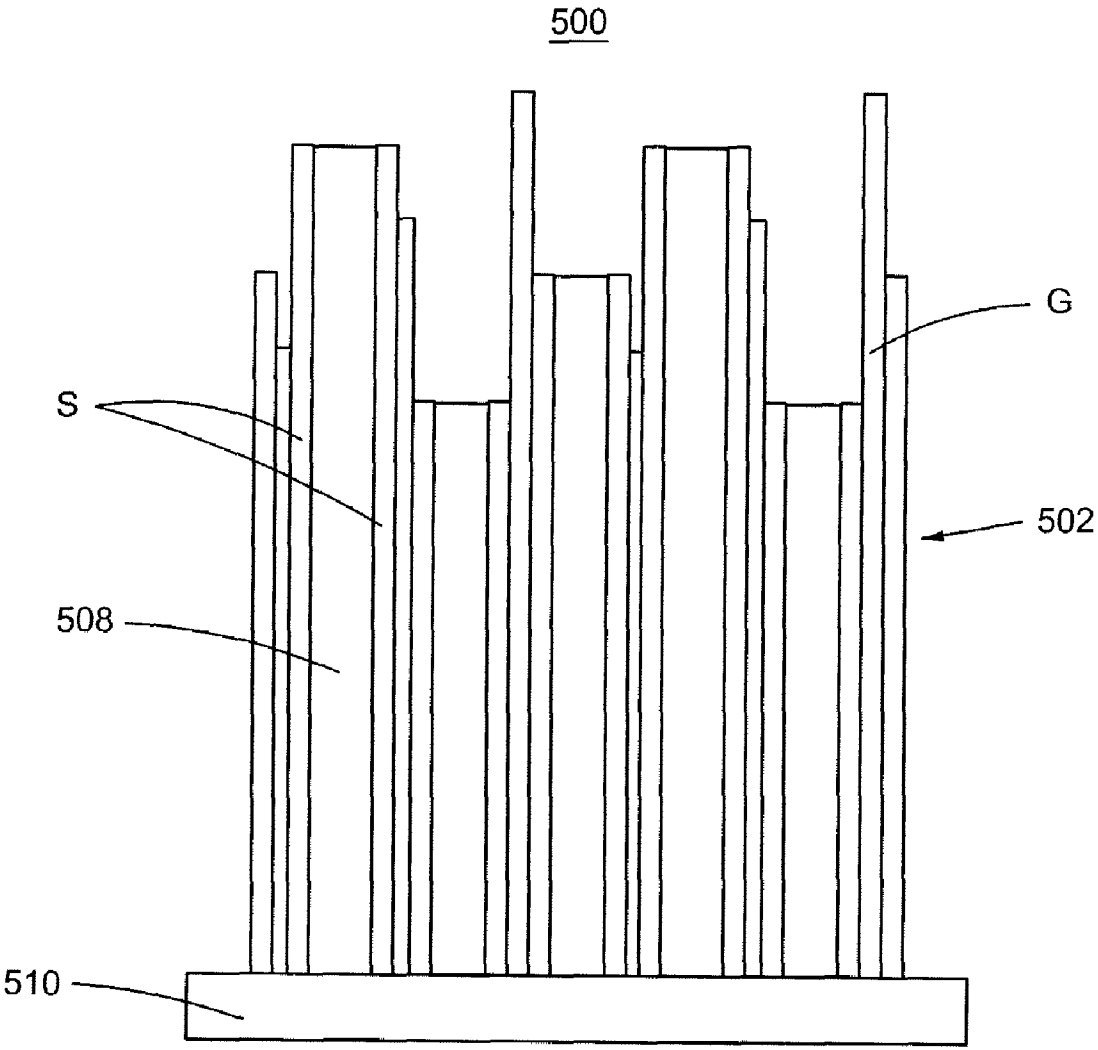

FIGS. 5A and 5B depict isometric and rear views, respectively, of a connector 500 according to an embodiment. The connector 500 may be a plug connector or a receptacle connector. The connector 500 may be devoid of ground plates and/or crosstalk shields. The connector 500 may be mounted to a printed circuit board 510, which may include one or more via holes 512. The connector 500 is shown as a right-angle connector. However, it will be appreciated that the connector 500 may be a vertical connector in alternative embodiments.

The connector 500 may include a connector housing (not shown), one or more leadframe assemblies (not shown), and electrical contacts 502. Each leadframe assembly may be an IMLA and may house a linear array of the electrical contacts 502. For example, the electrical contacts 502 in each linear array may be arranged edge-to-edge, i.e., the edges of adjacent electrical contacts 502 may face one another.

Each electrical contact 502 may define at least three portions along its length. For example, each electrical contact 502 may define a mating end 544, a lead portion 546, and a terminal end 548. As shown in FIG. 5A, each mating end 544 may be blade-shaped and may be adapted to be received via a corresponding female contact (not shown). Alternatively, each mating end 544 may include one or more tines that are adapted to mate with one or more sides of a corresponding male contact (not shown). Each terminal end 548 may be configured to attach to the printed circuit board 510 in any suitable manner. For example, each terminal end 548 may be press-fit into one of the via holes 512 defined by the printed circuit board 510, or may be surface mounted to the printed circuit board 510 with fusible elements such as solder balls. Each lead portion 546 may extend from the terminal end 548 to the mating end 544. As will be further discussed below, the electrical contacts 502 of the connector 500 may include signal contacts S and/or ground contacts G.

The connector 500 may further include a non-air dielectric, such as a dielectric material 508, positioned between adjacent leadframe assemblies. In particular, the dielectric material 508 may be positioned between adjacent signal contacts S housed by respective adjacent leadframe assemblies. The dielectric material 508 may be made from any suitable material, such as plastic, for example. The dielectric material 508 may be molded as part of the leadframe assemblies, or may be molded independent of the leadframe assemblies and subsequently inserted therebetween.

Figure 5C:
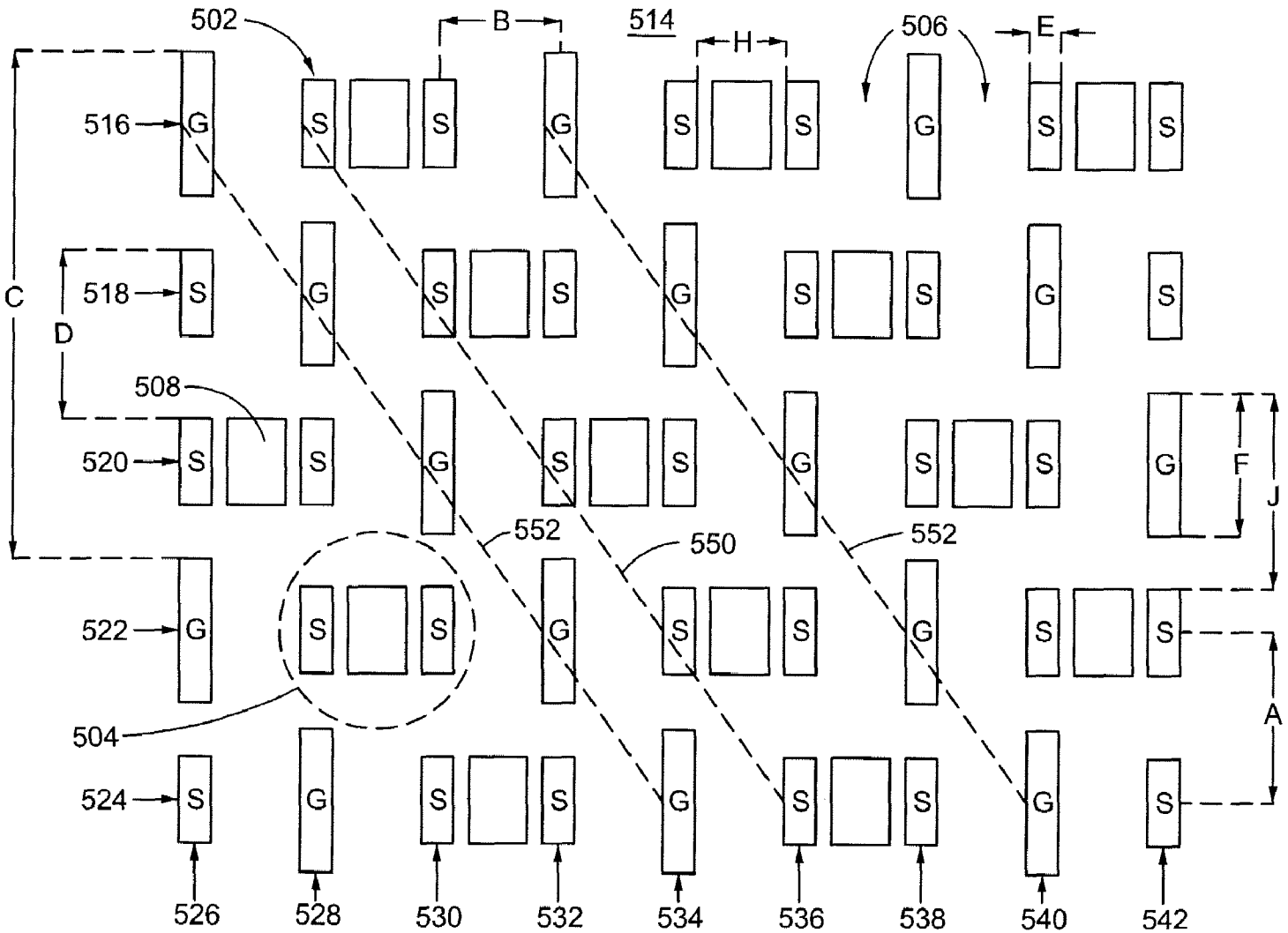
FIG. 5C depicts an example contact arrangement of the connector shown in FIGS. 5A and 5B.

FIG. 5C depicts a contact arrangement 514, viewed from the face of the connector 500, that includes linear arrays of the electrical contacts 502. The electrical contacts 502 may be arranged in a 5×9 array and may define contact rows 516, 518, 520, 522, 524 and contact columns 526, 528, 530, 532, 534, 536, 538, 540, 542, though any suitable configuration is consistent with an embodiment. Each column 526, 528, 530, 532, 534, 536, 538, 540, 542 may correspond to an IMLA. As shown in FIG. 5C, each electrical contact 502 in the connector 500 may have a cross-section that defines two opposing edges and two opposing broadsides. As further shown in FIG. 5C, the broadsides of the ground contacts G may be larger than the broadsides of the signal contacts S. For example, the lengths of the broadsides of the ground contacts G in the direction of the columns 526, 528, 530, 532, 534, 536, 538, 540, 542 may be longer than the lengths of the signal contact S in the same direction. In an embodiment, the lengths of the broadsides of the ground contacts G may be approximately two times greater than the lengths of the broadsides of the signal contacts S.

The electrical contacts 502 may be arranged edge-to-edge along each of the columns 526, 528, 530, 532, 534, 536, 538, 540, 542. In addition, the electrical contacts 502 may be arranged broadside-to-broadside along each of the rows 516, 518, 520, 522, 524. Adjacent signal contacts S in each of the rows 516, 518, 520, 522, 524 may form a pair of differential signal contacts 504. A ground contact G may be disposed between each pair of differential signal contacts 504 in the rows 516, 518, 520, 522, 524. In addition, the dielectric material 508 may be disposed between the signal contacts S of each pair of differential signal contacts 504. The dielectric material 508 may be used to increase field strength within the pair of differential signal contacts 504 while not increasing pair-to-pair coupling, crosstalk, and/or noise. Moreover, the ground contacts G and the signal contacts S may be surrounded on all sides by a dielectric 506, which may be air.

Referring back to FIG. 5A, the dielectric material 508 may extend along a length of the respective signal contacts S in each pair of differential signal contacts 504 (i.e., from approximately the mating end 544 to the terminal end 548 of each signal contact S). Moreover, the signals contacts S of a respective pair of differential signal contacts 504 may have substantially equal lengths as measured between the mating ends 544 and the terminal ends 548 of the signal contacts S. Thus, each pair of differential signal contacts 504 may exhibit approximately zero signal skew.

Each of the contact columns 526, 528, 530, 532, 534, 536, 538, 540, 542 may define a contact pattern, i.e., an arrangement of ground contacts G and signal contacts S. For example, the electrical contacts 502 in the column 526 may be arranged (moving from top to bottom) in a G-S-S-G-S pattern. The electrical contacts 502 in the column 528 may be arranged in a S-G-S-S-G pattern, though it will be appreciated that the contact pattern in the column 528 may be the same as the contact pattern in the column 526 when viewed from bottom to top. The electrical contacts 502 in the column 530 may be arranged in a S-S-G-S-S pattern, which may be different from the respective contact patterns in the columns 526, 528.

The contact patterns in the columns 526, 528, 530 may be repeated in the remaining columns, i.e., the column 532 may have the same contact pattern as the column 526, the column 534 may have the same contact pattern as the column 528, the column 536 may have the same contact pattern as the column 530, and so on. Thus, each pair of differential signal contacts 504 in the row 518 may be offset (along the row-direction) by one full column pitch from the nearest pair of differential signal contacts 504 in the row 516. Similarly, each pair of differential signal contacts 504 in the row 520 may be offset (along the row-direction) by one full column pitch from the nearest pair of differential signal contacts 504 in the row 518. It will be appreciated that some of the signal contacts S may be neutral contacts, or "extra pins," and may not be needed for the formation of a pair of differential signal contacts 504.

As shown in FIG. 5C, one of the signal contacts S from each pair of differential signal contacts 504 in the rows 516, 518, 520, 522, 524 may form an array defined by an imaginary line 550. For example, the line 550 may extend from an approximate center point on a side of a signal contact S in the column 528 to an approximate center point on the same side of another signal contact S in the column 536. Similarly, the ground contacts G in rows 516, 518, 520, 522, 524 may also form an array defined by an imaginary line 552. For example, the line 552 may extend from an approximate center point on a side of a ground contact G in the column 532 to an approximate center point on the same side of another ground contact G in the column 540.

It will be appreciated that the imaginary lines 550, 552 may extend from any suitable point on the same sides of the signal contact S and the ground contacts G, respectively. It will be further appreciated that the imaginary lines 550, 552 may each define an oblique angle with respect to the direction of the columns 526, 528, 530, 532, 534, 536, 538, 540, 542. The oblique angles defined by the lines 550, 552 may be substantially the same or may differ from one another. As shown in FIG. 5C, the array formed along the line 550 by the pairs of differential signal contacts 504 may be disposed between two arrays formed along respective lines 552 by the ground contacts G.

The offset of the ground contacts G from row-to-row may be none, less than a column pitch, equal to a column pitch, or more than a column pitch. Similarly, the offset of the pairs of differential signal contacts 504 from row-to-row may be none, less than a column pitch, equal to a column pitch, or more than a column pitch. A row-to-row centerline spacing A may be about 1.4 mm to 2.5 mm, with approximately 2 mm the preferred spacing. A column-to-column centerline spacing B may be about 1.3 mm to 2.5 mm, with approximately 1.8 mm the preferred spacing. A ground-to-ground spacing C in each column may be about 3.9 mm to 6 mm, with approximately 5.4 mm the preferred spacing. A signal-to-signal spacing D in each column may be about 1.2 mm, but can be in a range of about 0.3 mm to 2 mm. A material thickness E of the ground contacts G and/or the signal contacts S may be in a range of 0.2 mm to 0.4 mm, with approximately 0.35 mm the preferred thickness. A height F of each ground contact G is preferably about 2.4 mm, but the height F may range from about 1 mm to 2.9 mm. A spacing J between a ground contact G and an adjacent signal contact S in a column may be about 0.4 mm, but can be in a range of 0.2 mm to 0.7 mm. A gap distance H between signal contacts S that define a pair of differential signal contacts 504 is about 0.2 mm to 2.5 mm, with a gap distance of about 1.8 mm preferred with the dielectric material 508 disposed between the signal contacts S that form the pair. However, the signal contacts S in a column may be offset from the array centerline spacing by a material stock thickness or more, with a approximate 0.2 mm to 0.3 mm offset in opposite directions preferred.

In an embodiment, the column 528 may include a first signal contact S and a second signal contact S arranged edge-to-edge along the column 528. The column 526 may include a third signal contact S adjacent to the first signal contact S in the column 528. The column 530 may include a fourth signal contact S adjacent to the second signal contact S in the column 528. As shown in FIG. 5C, the first and third signal contacts may be arranged broadside-to-broadside and the second and fourth signal contacts may be arranged broadside-to-broadside in a direction substantially perpendicular to the column 528. The first and third signal contacts may define a first pair of differential signal contacts 504 and the second and fourth signal contacts may define a second pair of differential signal contacts 504. As further shown in FIG. 5C, the first and second pairs of differential signal contacts 504 may be offset from one another in the direction substantially perpendicular to the column 528.

Figure 6:
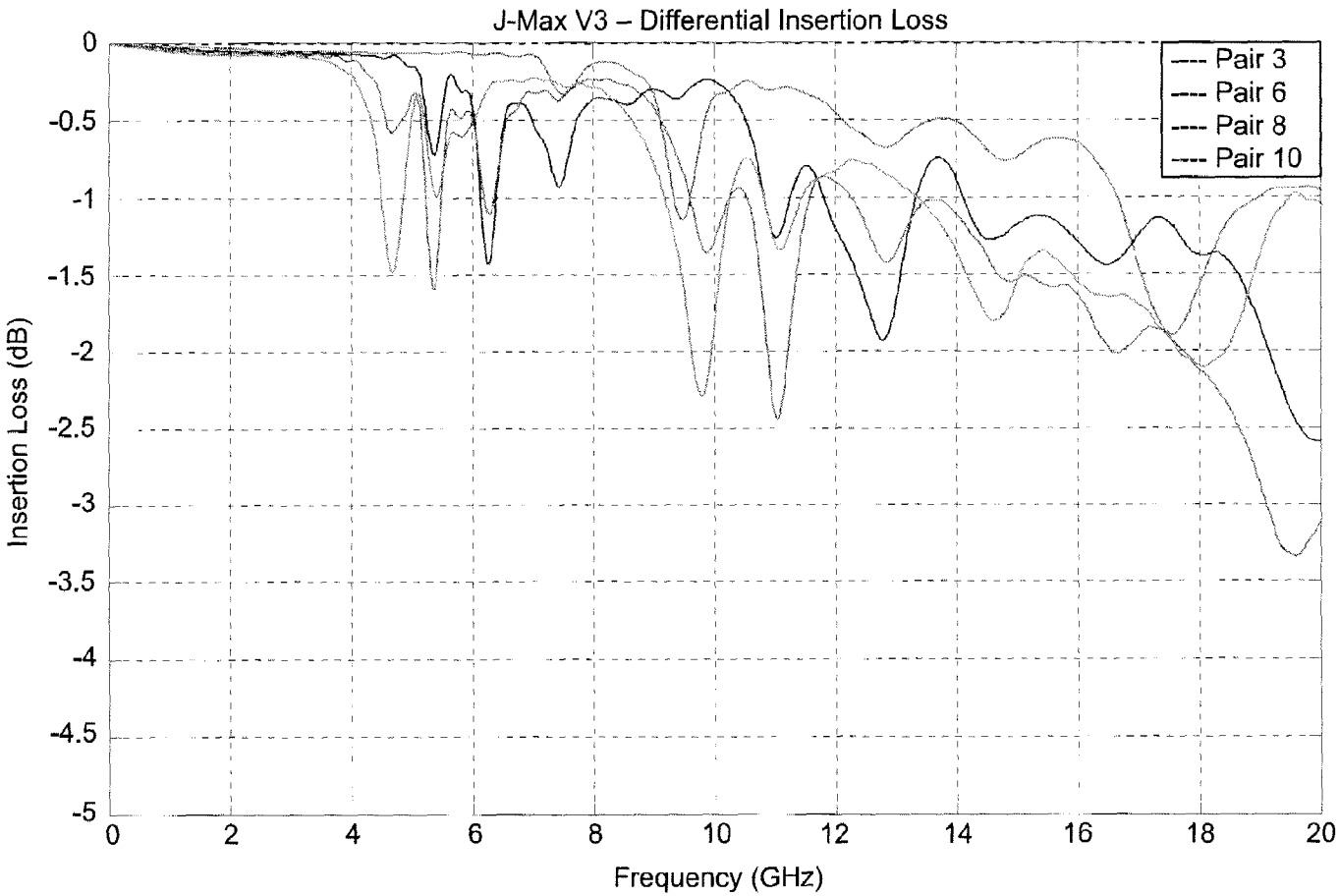
FIG. 6 is a comparison plot of differential insertion loss versus frequency exhibited by the connector shown in FIGS. 5A-5C.

FIG. 6 is a comparison plot 600 of differential insertion loss versus frequency exhibited by four pairs of differential signal contacts 504 in the connector 500. As shown in FIG. 6, the connector 500 may exhibit an insertion loss suck out of approximately −1.5 dB in the 4 to 6 GHz frequency range.

Figure 7:
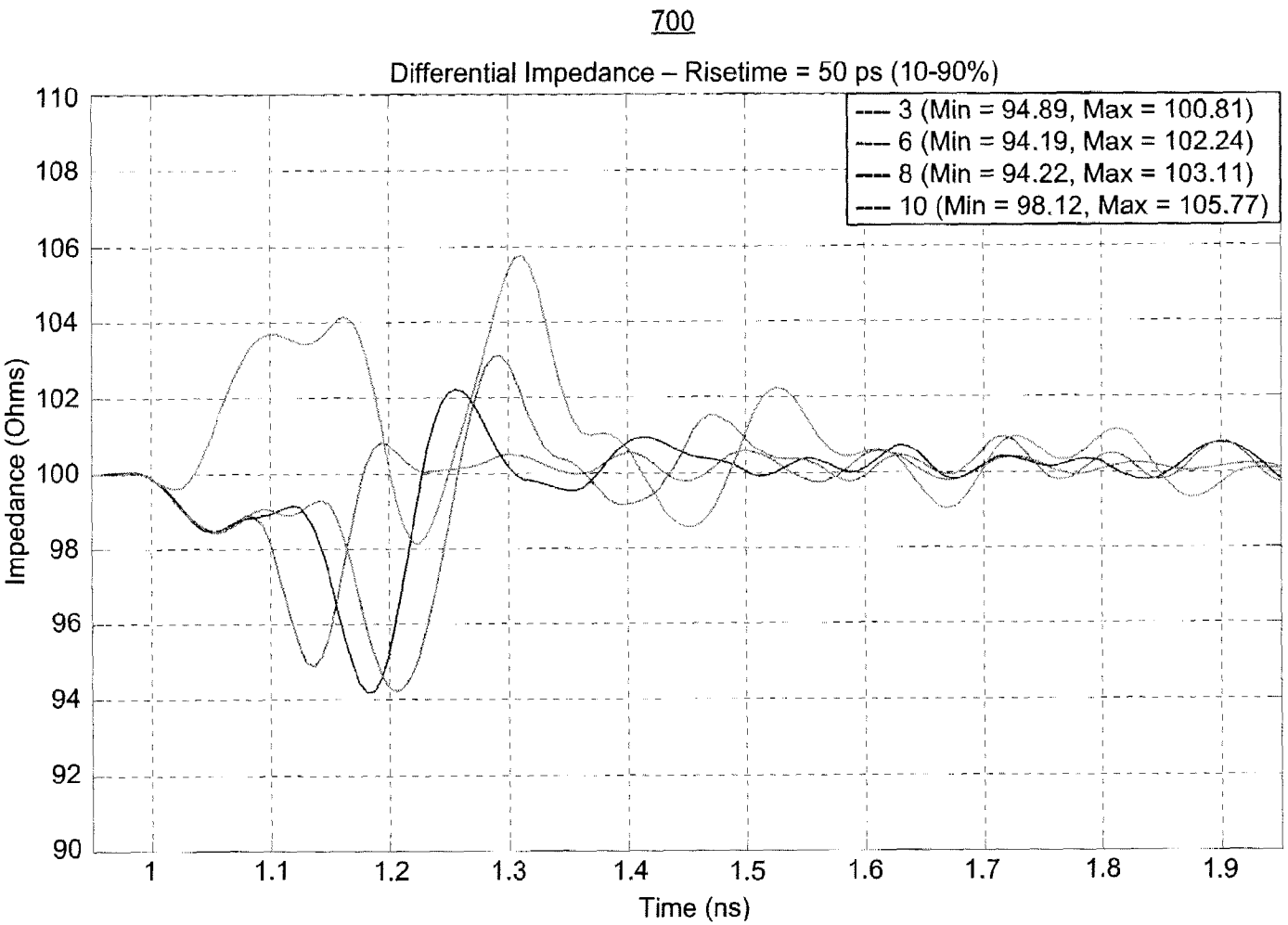
FIG. 7 is a comparison plot of differential impedance versus time exhibited by the connector shown in FIGS. 5A-5C.

FIG. 7 is a comparison plot 700 of differential impedance versus time exhibited by the four pairs of the differential signal contacts 504 in the connector 500. As shown in FIG. 7, the connector 500 may exhibit a differential impedance of approximately 100 ohms plus or minus 6%.

FIG. 8 is a table 800 summarizing multi-active, worst-case crosstalk exhibited by the four pairs of differential signal contacts 504 in the connector 500. As shown in FIG. 8, the connector 500 may exhibit a multi-active, worst case crosstalk in a range of about 2.6% to 5.5%. Far end crosstalk is shown in the upper two quadrants of FIG. 8, and near end crosstalk is shown in the lower two quadrants of FIG. 8. Although rise time is indicated as 50 (10-90%) picoseconds, the measurement may be between 35-1000 (10-90% or 20-80%) picoseconds. These values generally may correspond to data transfer rates of about ten or more Gigabits per second to less than 622 Megabits per second.

Figure 9A:
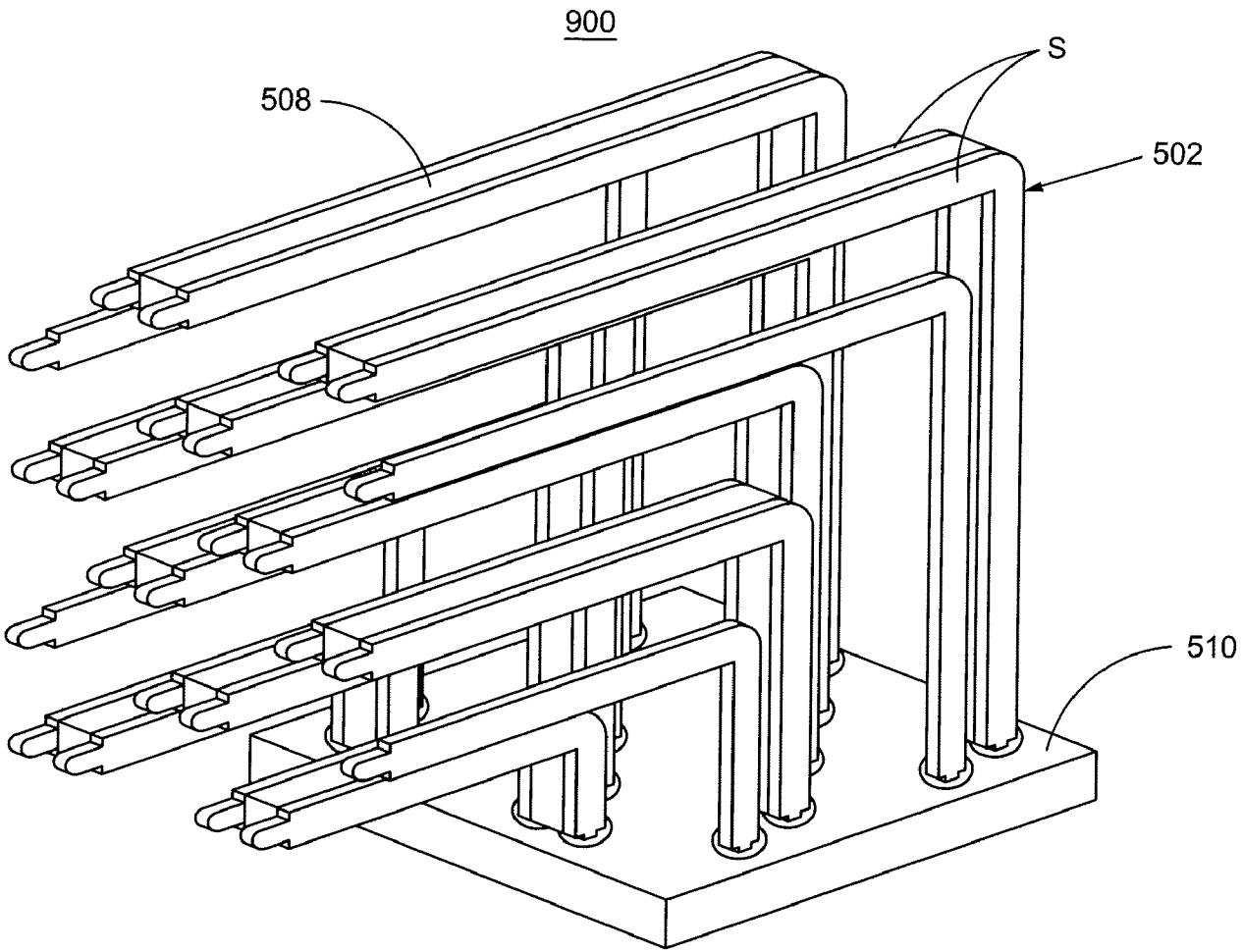
FIGS. 9A and 9B depict a portion of a connector, in isometric views, according to another embodiment.
Figure 9B:
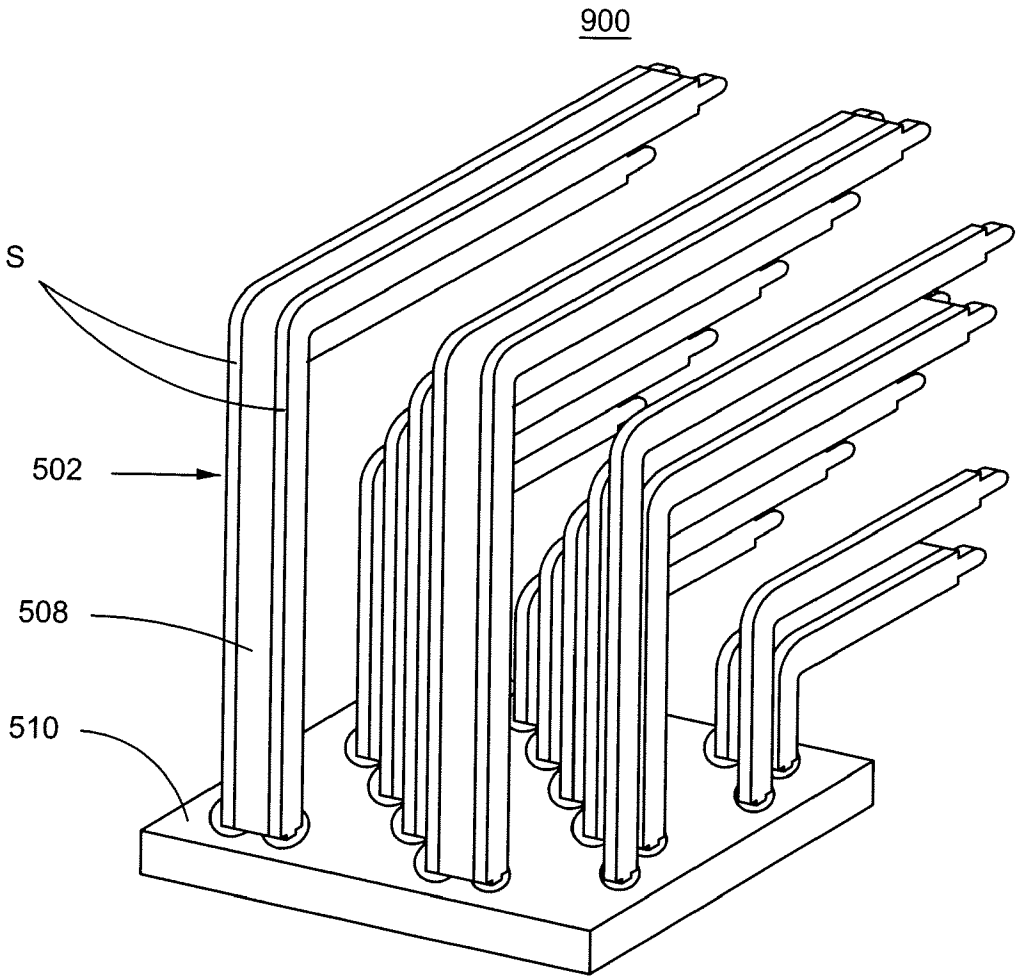
Figure 9C:
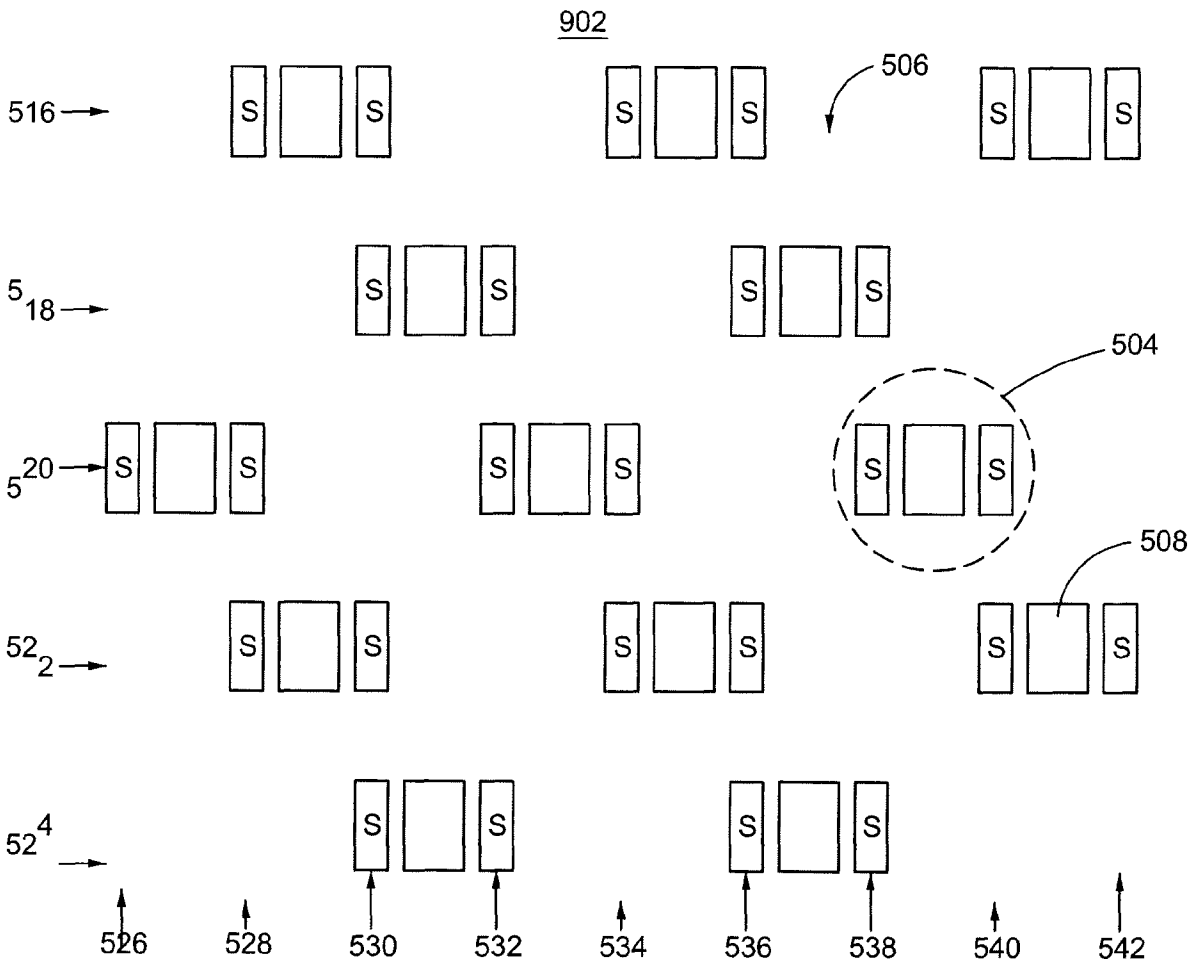
FIG. 9C depicts an example contact arrangement of the connector shown in FIGS. 9A and 9B.

FIGS. 9A and 9B depict isometric views of a connector 900 according to another embodiment. FIG. 9C depicts a contact arrangement 902, viewed from the face of the connector 900, that includes linear arrays of the electrical contacts 502. Like the connector 500, the connector 900 may be devoid of ground plates and/or crosstalk shields. The connector 900 may be a right-angle connector that is mounted to the printed circuit board 510, though it will be appreciated that the connector 900 may be a vertical connector in alternative embodiments.

The connector 900 generally may include the same features and/or elements as the connector 500, such as one or more leadframe assemblies (not shown) for housing linear arrays of the electrical contacts 502 and a dielectric material 508 disposed between adjacent signal contacts S. As shown in FIGS. 9A and 9B, the dielectric material 508 may extend along a length of the respective signal contacts S in each pair of differential signal contacts 504. In addition, the connector 900 may have the same or similar contact and contact spacing dimensions as the connector 500.

As shown in FIG. 9C, the connector 900 may differ from the connector 500 in that the connector 900 may be devoid of any ground contacts G. More specifically, the contact arrangement 902 may include one or more signal contacts S arranged edge-to-edge along each of the columns 526, 528, 530, 532, 534, 536, 538, 540, 542. In addition, the signal contacts S may be arranged broadside-to-broadside along each of the rows 516, 518, 520, 522, 524. Adjacent signal contacts S in each of the rows 516, 518, 520, 522, 524 may form pairs of differential signal contacts 504. Unlike the connector 500, a ground contact G may not be disposed between each pair of differential signal contacts 504 in the rows 516, 518, 520, 522, 524 of the connector 900.

Figure 10:
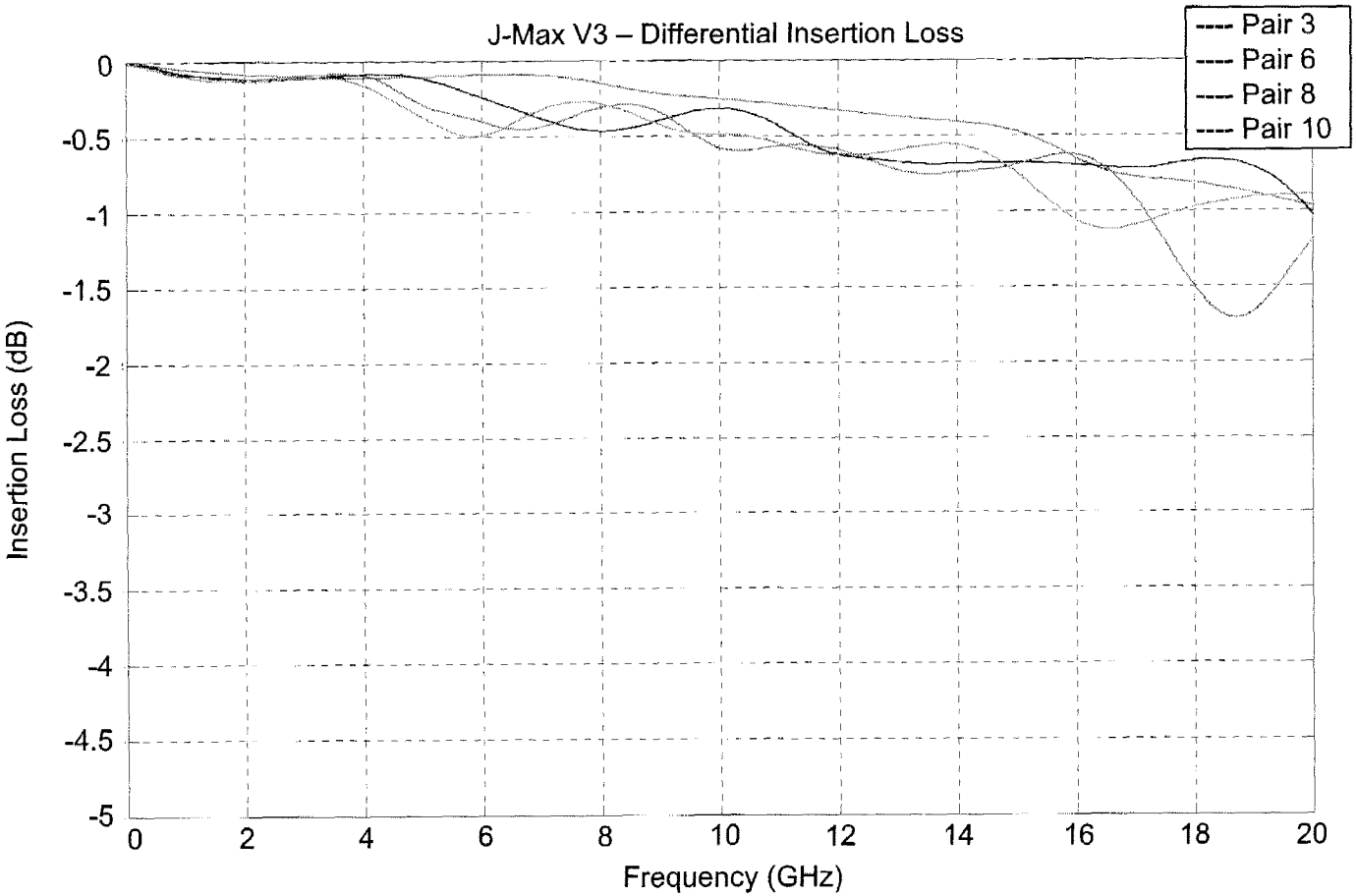
FIG. 10 is a comparison plot of differential insertion loss versus frequency exhibited by the connector shown in FIGS. 9A-9C.

FIG. 10 is a comparison plot 1000 of differential insertion loss versus frequency exhibited by four pairs of differential signal contacts 504 in the connector 900. As shown in FIG. 10, the connector 900 may exhibit an insertion loss suck out of approximately −0.5 dB in the 4 to 6 GHz frequency range.

Figure 11:
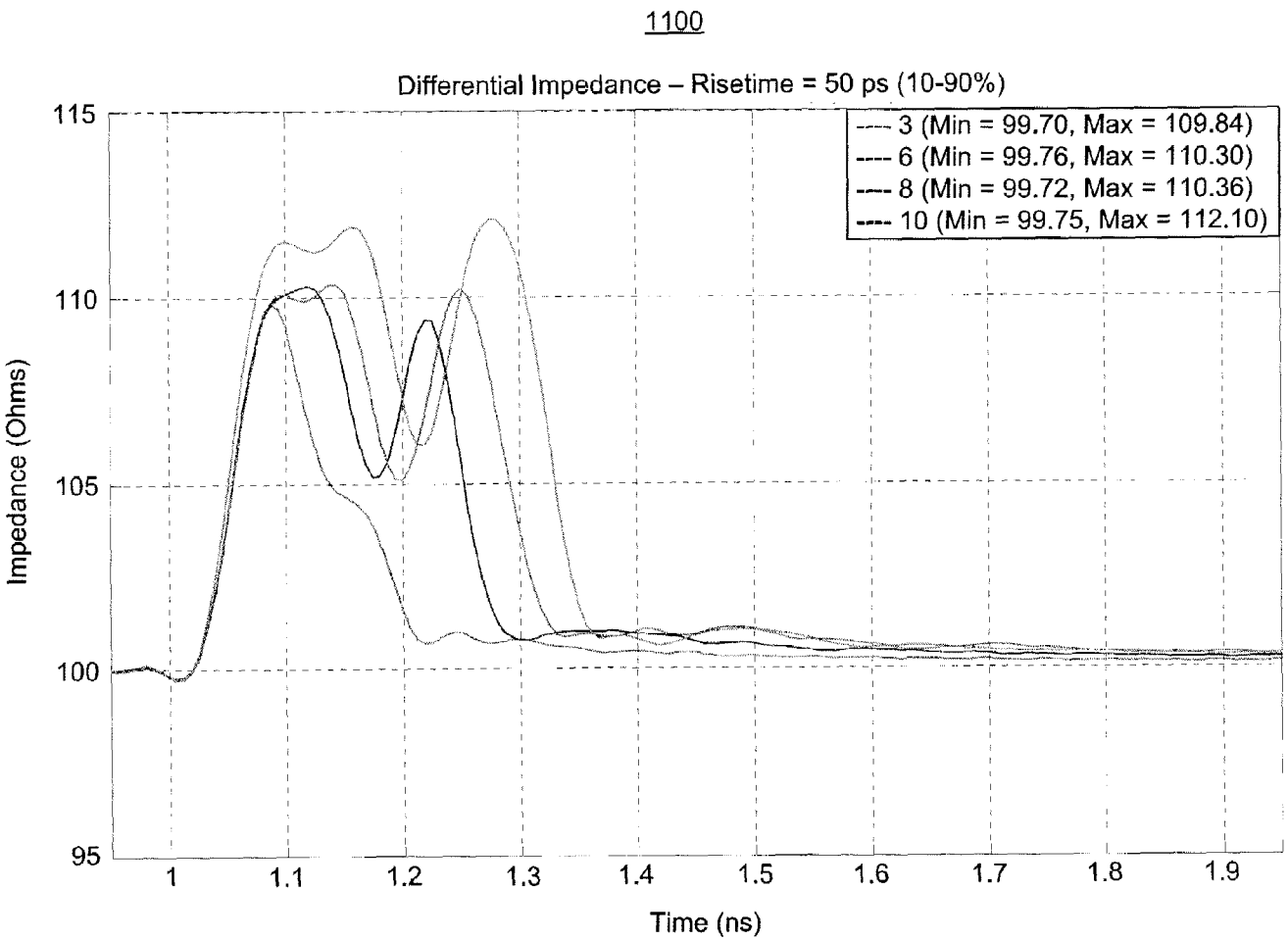
FIG. 11 is a comparison plot of differential impedance versus time exhibited by the connector shown in FIGS. 9A-9C.

FIG. 11 is a comparison plot 1100 of differential impedance versus time exhibited by the four pairs of the differential signal contacts 504 in the connector 900. As shown in FIG. 11, the differential impedance for all but one of the pairs of differential signal contacts 504 may be approximately 100 ohms plus or minus 10%. It will be appreciated that the differential impedance may be adjusted (i.e., matched to a system impedance) by moving the signal contacts S that form a pair of differential signal contacts 504 closer together or farther apart, by increasing or decreasing the width of the signal contacts S, and/or by increasing or decreasing a dielectric constant in the gap between the signal contacts S.

FIG. 12 is a table 1200 summarizing multi-active, worst-case crosstalk exhibited by the four pairs of differential signal contacts 504 in the connector 900. As shown in FIG. 12, the connector 900 may exhibit a multi-active, worst case crosstalk in a range of about 2.7% to 4.1%. Far end crosstalk is shown in the upper two quadrants of FIG. 12, and near end crosstalk is shown in the lower two quadrants of FIG. 12.

Figure 13A:
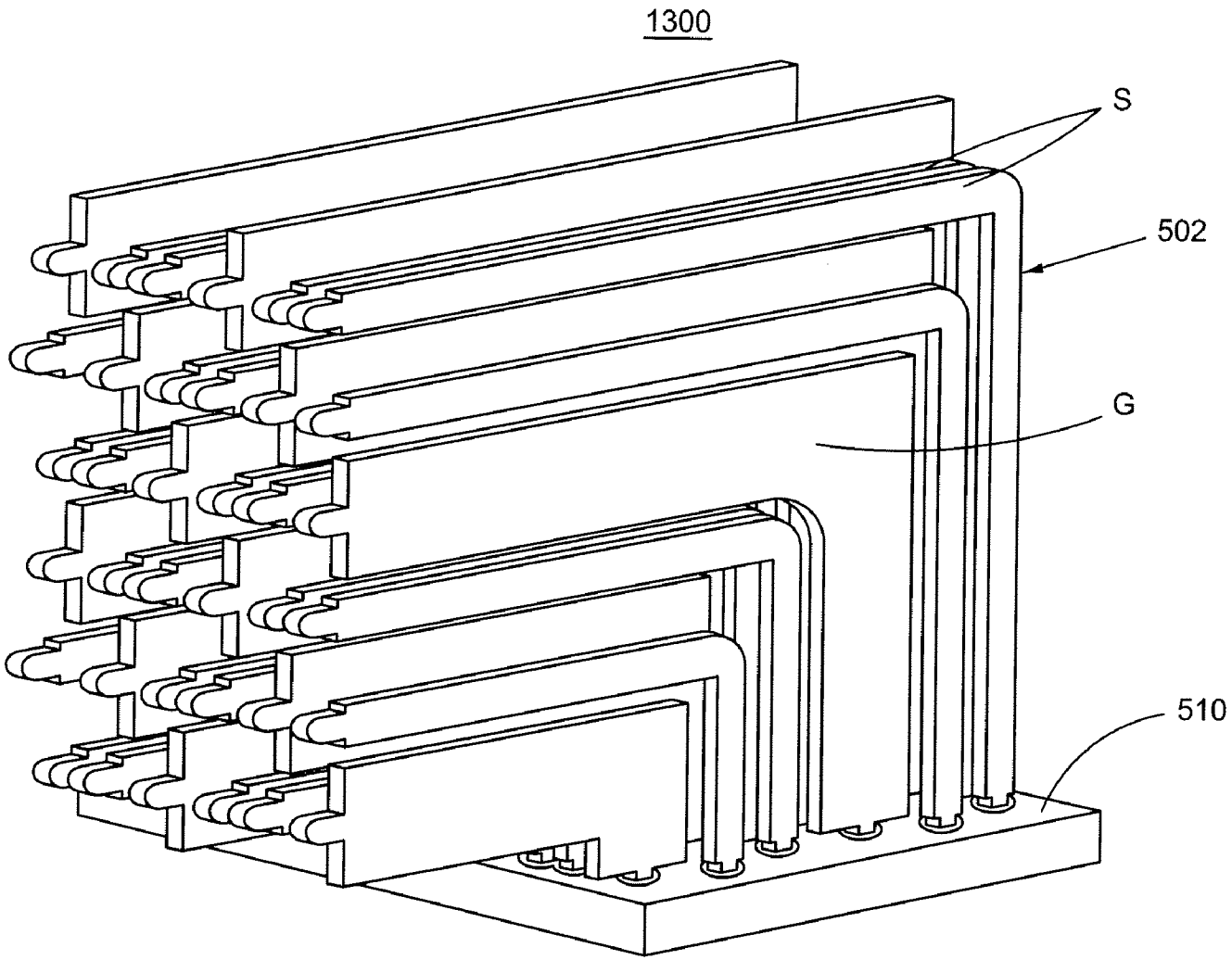
FIGS. 13A and 13B depict a portion of a connector, in isometric views, according to another embodiment.
Figure 13C:
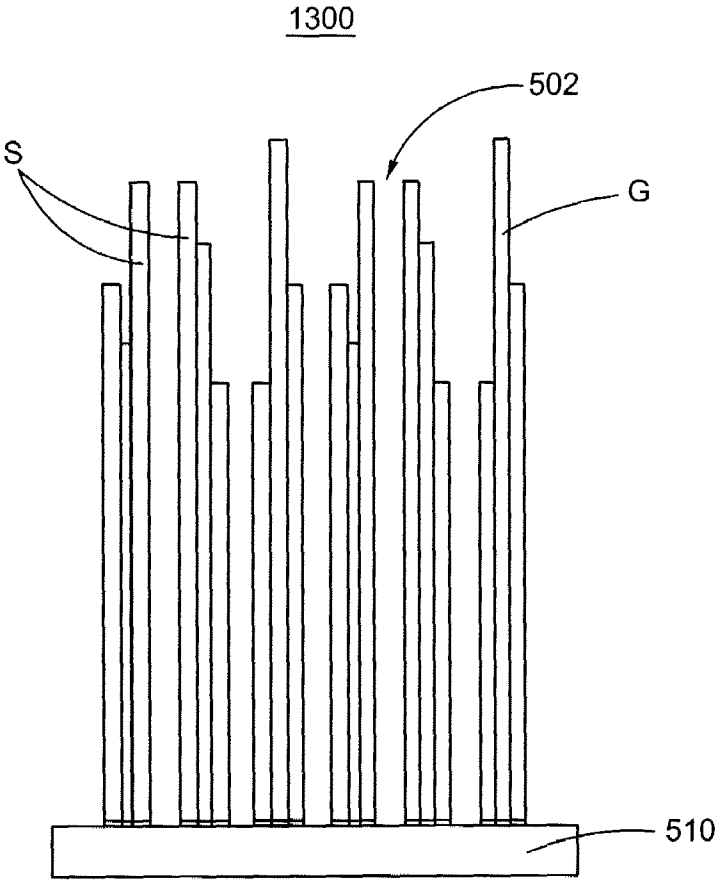
FIG. 13C depicts a rear view of a portion of the connector shown in FIGS. 13A and 13B.
Figure 13B:
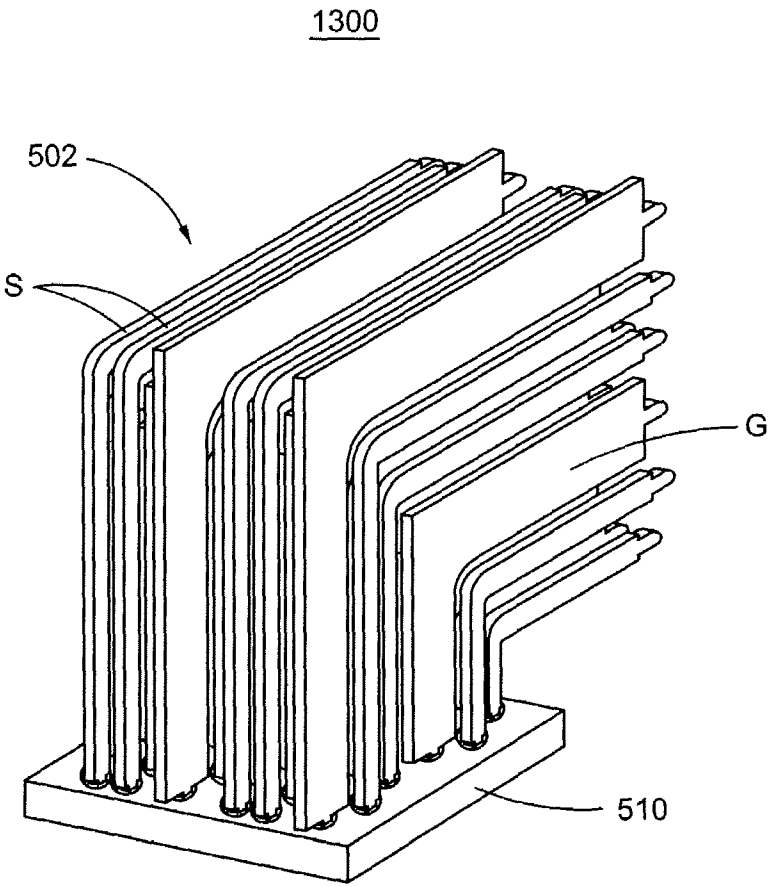
Figure 13D:
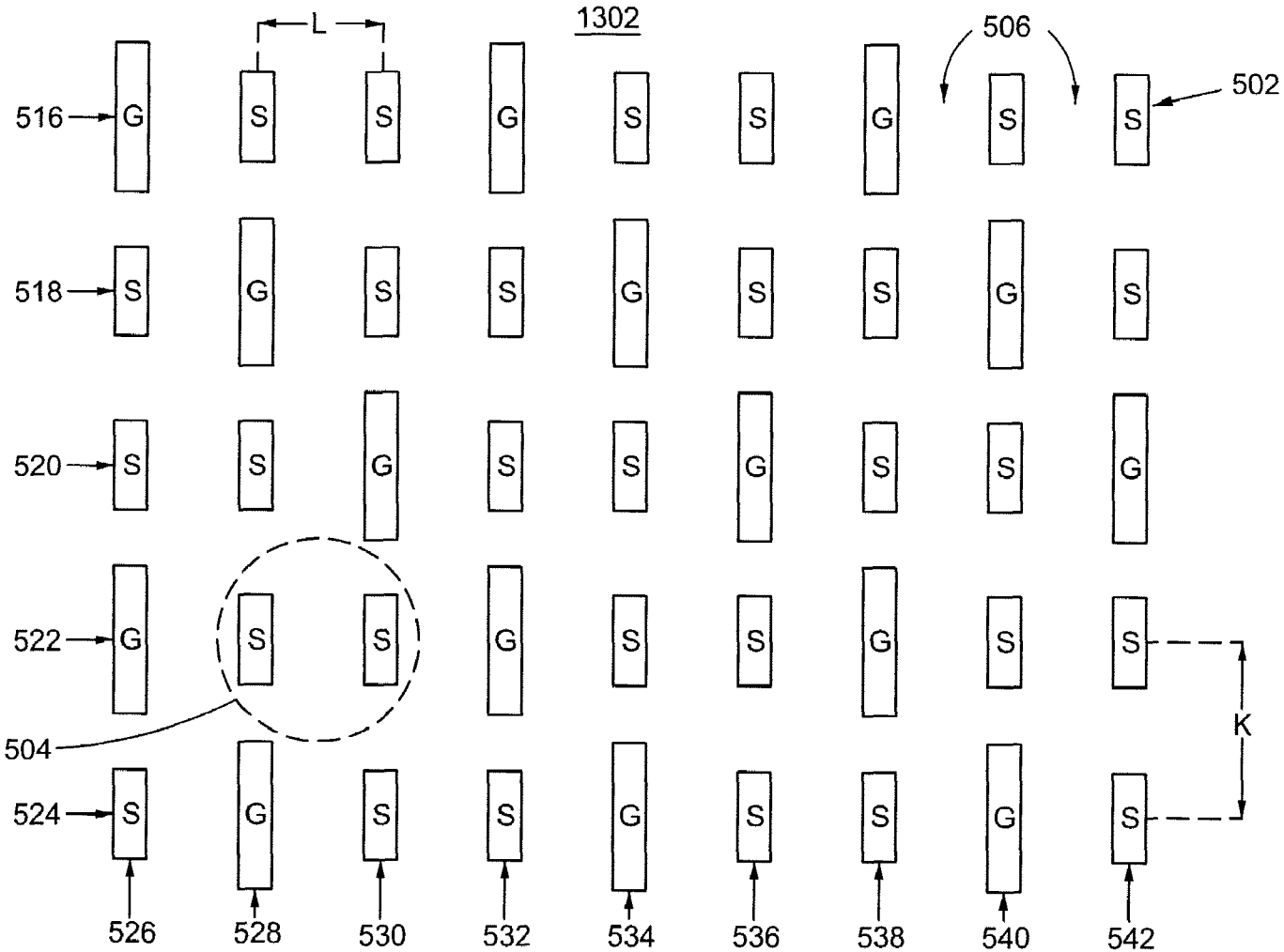
FIG. 13D depicts an example contact arrangement of the connector shown in FIGS. 13A-13C.

FIGS. 13A and 13B depict isometric views of a connector 1300 according to another embodiment. FIG. 13C depicts a rear view of the connector 1300. FIG. 13D depicts a contact arrangement 1302, viewed from the face of the connector 1300, that includes linear arrays of the electrical contacts 502. Like the connector 500, the connector 1300 may be devoid of ground plates and/or crosstalk shields. The connector 1300 may be a right-angle connector that is mounted to the printed circuit board 510, though it will be appreciated that the connector 1300 may be a vertical connector in alternative embodiments.

The connector 1300 generally may include the same features and/or elements as the connector 500, such as one or more leadframe assemblies (not shown) for housing linear arrays of the electrical contacts 502. Each linear array may include the ground contacts G and the signal contacts S. In addition, the connector 1300 may have the same or similar contact and contact spacing dimensions as the connector 500 as well as the same or similar contact arrangements.

As shown in FIG. 13D, the connector 1300 may differ from the connector 500 in that the connector 1300 may not include the dielectric material 508 disposed between adjacent signal contacts S that form a pair of differential signal contacts 504. Moreover, a row-to-row centerline spacing K may be about 1.4 mm to 3, with 1.65 mm to 2 mm being the preferred spacing. A column-to-column centerline spacing L is about 1.3 mm to 2.5 mm, with 1.4 mm to 1.5 mm being the preferred spacing.

Figure 14:
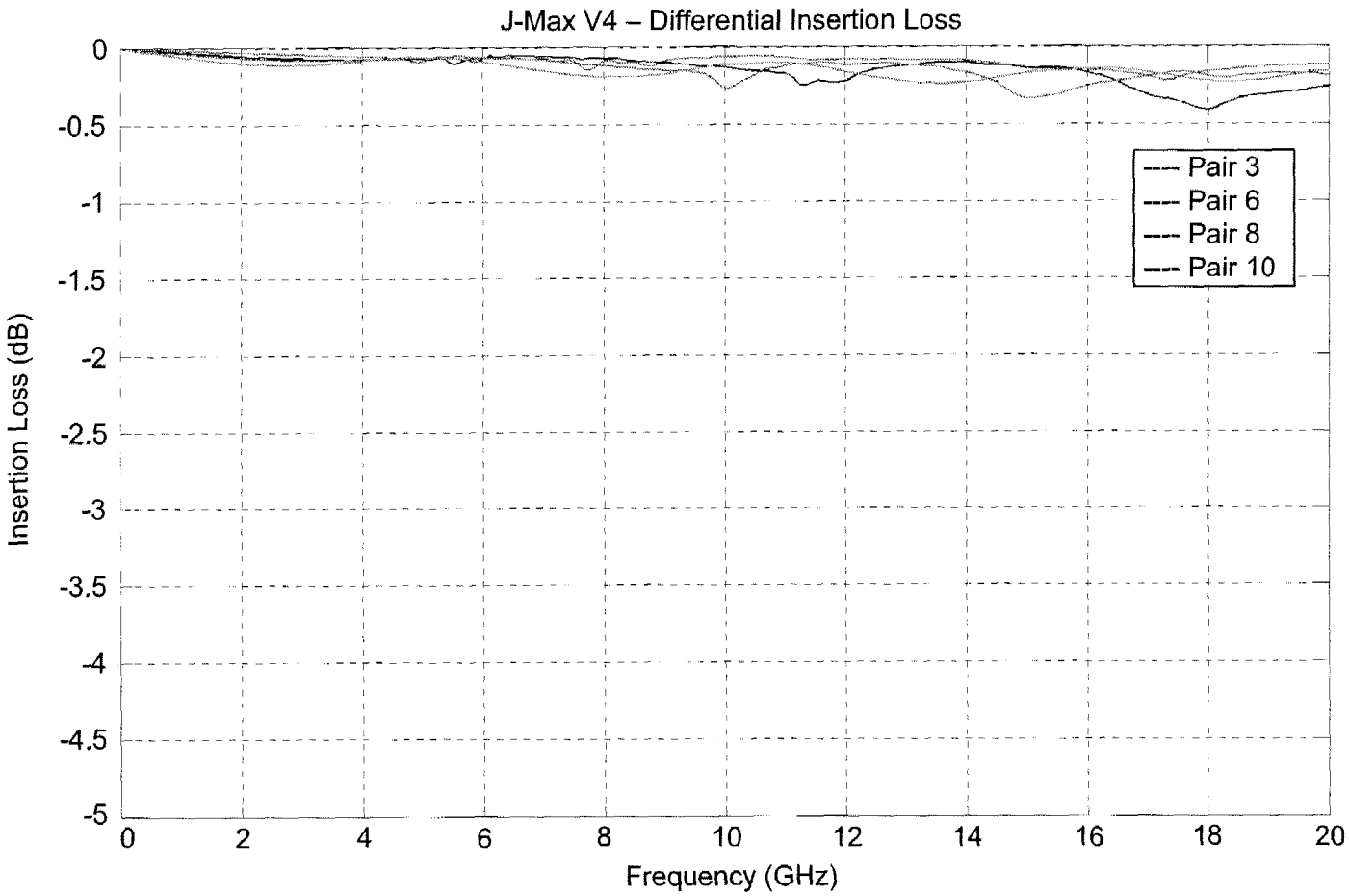
FIG. 14 is a comparison plot of differential insertion loss versus frequency exhibited by the connector shown in FIGS. 13A-13D.

FIG. 14 is a comparison plot 1400 of differential insertion loss versus frequency exhibited by four pairs of differential signal contacts 504 in the connector 1300. As shown in FIG. 14, the connector 1300 may exhibit an insertion loss of less than −0.5 dB up to 20 GHz and approximately zero suck out in a 0 to 20 GHz frequency range. In addition, the insertion loss values demonstrate minimal tapering in the 0 to 20 GHz frequency range. Consequently, the insertion loss for one or more of the pairs of differential signal contacts 504 may remain below −2 dB or less up to at least 40 GHz.

Figure 15:
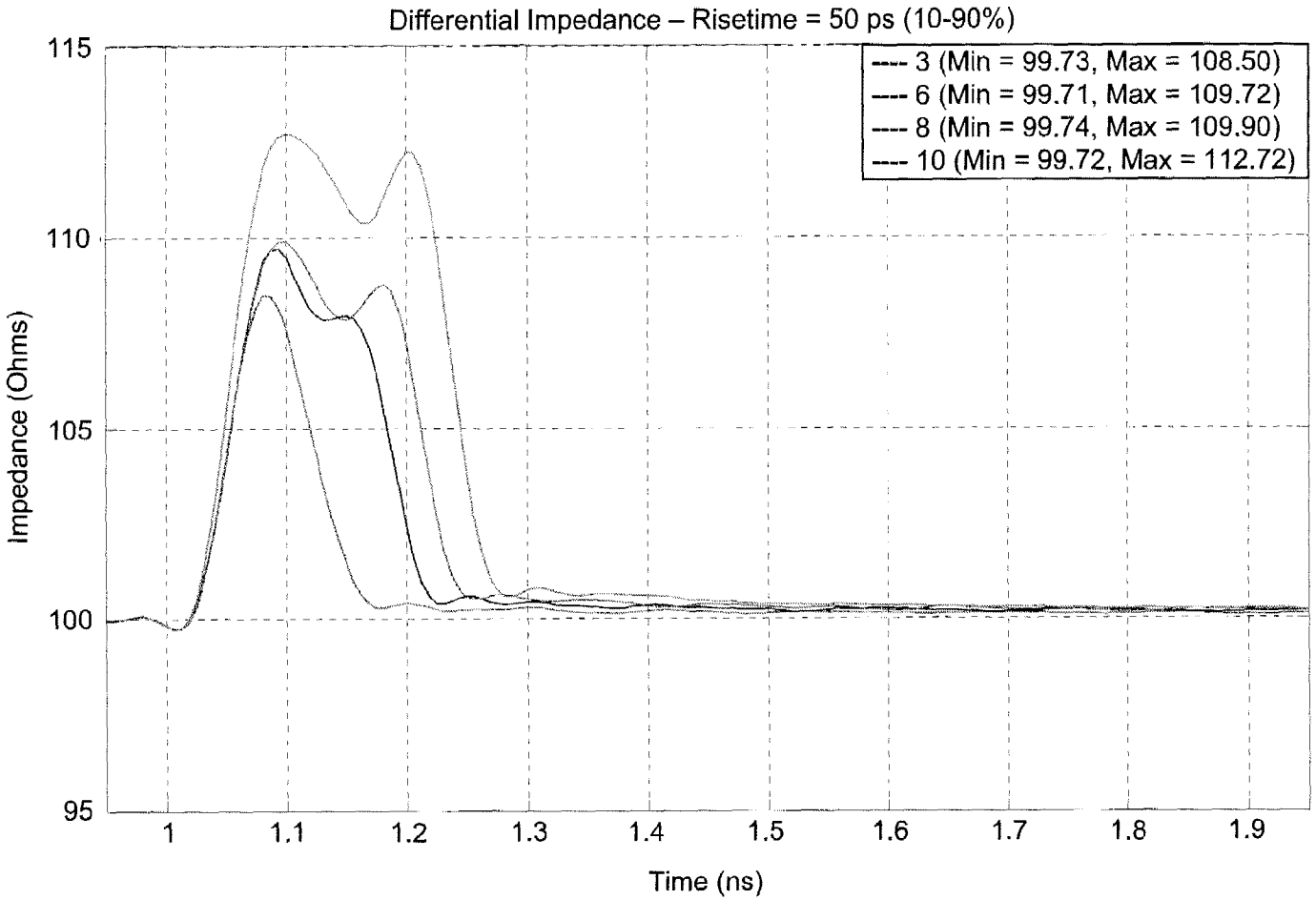
FIG. 15 is a comparison plot of differential impedance versus time exhibited by the connector shown in FIGS. 13A-13D.

FIG. 15 is a comparison plot 1500 of differential impedance versus time exhibited by the four pairs of the differential signal contacts 504 in the connector 1300. As shown in FIG. 15, the differential impedance for all but one of the pairs of differential signal contacts 504 may be approximately 100 ohms plus or minus 10%. As noted above, the differential impedance may be adjusted (i.e., matched to a system impedance) by moving the signal contacts S that form a pair of differential signal contacts 504 closer together or farther apart, by increasing or decreasing the width of the signal contacts S, and/or by increasing or decreasing a dielectric constant in the gap between the signal contacts S.

FIG. 16 is a table 1600 summarizing multi-active, worst-case crosstalk exhibited by the four pairs of differential signal contacts 504 in the connector 1300. As shown in FIG. 16, the connector 1300 may exhibit a multi-active, worst case crosstalk in a range of about 0.3% to 2.1%. Far end crosstalk is shown in the upper two quadrants of FIG. 16, and near end crosstalk is shown in the lower two quadrants of FIG. 16.

In one or more of the foregoing embodiments, at least a portion of the electrical contacts may be insert molded in plastic. Moreover, the electrical connectors may be configured for flat rock PCB press-fit insertion. For example, one or more linear arrays of electrical contacts may be laminated. Each laminated linear array may then be combined together to form a solid body or a collection of individual wafers. Alternatively, a four, five, or six sided box may be created around the electrical contacts. The interior of the box may then be filled with air, plastic, PCB material, or any combination thereof. The electrical connector may be mounted to a printed circuit board via solder balls, fusible elements, solder fillets, and the like.

Figure 17:
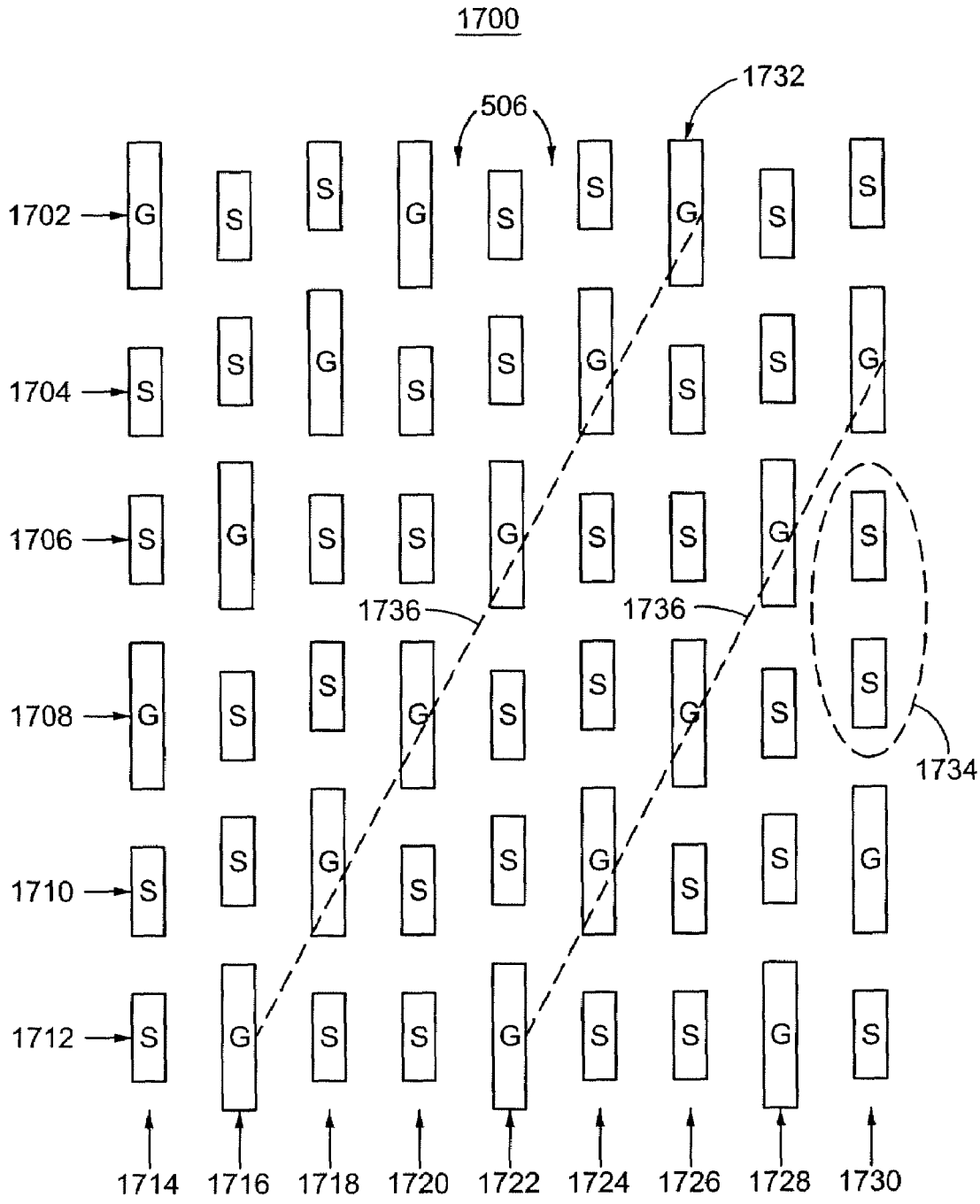
FIG. 17 depicts an example contact arrangement of an electrical connector according to another embodiment in which differential signal contacts are arranged edge-to-edge.

FIG. 17 depicts a contact arrangement 1700 viewed from the face of an electrical connector according to another embodiment in which differential signal contacts are arranged edge-to-edge. The contact arrangement 1700 may include linear arrays of electrical contacts 1732, which may include the ground contacts G and the signal contacts S. As shown in FIG. 17, the electrical contacts 1732 may be arranged in a 6×9 array and may define contact rows 1702, 1704, 1706, 1708, 1710, 1712 and contact columns 1714, 1716, 1718, 1720, 1722, 1724, 1726, 1728, 1730, though any suitable configuration is consistent with an embodiment. Each column 1714, 1716, 1718, 1720, 1722, 1724, 1726, 1728, 1730 may correspond to an IMLA. As shown in FIG. 17, each electrical contact 1732 in the connector may have a cross-section that defines two opposing edges and two opposing broadsides. As further shown in FIG. 17, the broadsides of the ground contacts G may be larger than the broadsides of the signal contacts S. For example, in an embodiment, the broadsides of the ground contacts G may be approximately two times greater than the broadsides of the signal contacts S.

The electrical contacts 1732 may be arranged edge-to-edge along each of the columns 1714, 1716, 1718, 1720, 1722, 1724, 1726, 1728, 1730. In addition, at least a portion of the electrical contacts 1732 may be arranged broadside-to-broadside along each of the rows 1702, 1704, 1706, 1708, 1710, 1712. Adjacent signal contacts S in each of the columns 1714, 1716, 1718, 1720, 1722, 1724, 1726, 1728, 1730 may form a pair of differential signal contacts 1734. A ground contact G may be disposed between each pair of differential signal contacts 1734 in the columns 1714, 1716, 1718, 1720, 1722, 1724, 1726, 1728, 1730. The ground contacts G and the signal contacts S may be surrounded on all sides by the dielectric 506.

Each of the contact columns 1714, 1716, 1718, 1720, 1722, 1724, 1726, 1728, 1730 may define a contact pattern. For example, the electrical contacts 1732 in the column 1714 may be arranged (moving from top to bottom) in a G-S-S-G-S-S pattern. The electrical contacts 1732 in the column 1716 may be arranged in a S-S-G-S-S-G pattern, though it will be appreciated that the contact pattern in the column 1716 may be the same as the contact pattern in the column 1714 when viewed from bottom to top. The electrical contacts 1732 in the column 1718 may be arranged in a S-G-S-S-G-S pattern, which may be different from the respective contact patterns in the columns 1714, 1716.

The contact patterns in the columns 1714, 1716, 1718 may be repeated in the remaining columns, i.e., the column 1720 may have the same contact pattern as the column 1714, the column 1722 may have the same contact pattern as the column 1716, the column 1724 may have the same contact pattern as the column 1718, and so on. It will be appreciated that some of the signal contacts S may be neutral contacts, or "extra pins," and may not be needed for the formation of a pair of differential signal contacts 1734.

As shown in FIG. 17, the ground contacts G in rows 1702, 1704, 1706, 1708, 1710, 1712 may form one or more arrays defined by an imaginary line 1736. For example, one of the lines 1736 may extend from an approximate center point on a side of a ground contact G in the column 1716 to an approximate center point on the same side of another ground contact G in the column 1726. It will be appreciated that the imaginary lines 1736 may extend from any suitable point on the same sides of the ground contacts G. Each imaginary line 1736 may define an oblique angle with respect to the direction of the columns 1714, 1716, 1718, 1720, 1722, 1724, 1726, 1728, 17302. The oblique angles defined by each line 1736 may be substantially the same or may differ from one another.

What is claimed:

1. An electrical connector comprising:

an array of electrical contacts extending along a plurality of rows and columns, wherein each of the columns is spaced apart from an adjacent column by a constant column pitch, and the array of electrical contacts includes:

a first electrical contact disposed in a first column and a second electrical contact disposed in a second column adjacent the first column, wherein the first and second electrical contacts are disposed in a first row and are arranged broadside-to-broadside so as to define a first broadside coupled differential signal pair;

a third electrical contact disposed in the second column and a fourth electrical contact disposed in a third column adjacent the second column, wherein the third and fourth electrical contacts are disposed in a second row adjacent the first row, and the third and fourth electrical contacts are arranged broadside-to-broadside so as to define a second broadside coupled differential signal pair; and a fifth electrical contact disposed in the first column and a sixth electrical contact disposed in a fourth column adjacent the first column, wherein the fifth and sixth electrical contacts are disposed in a third row adjacent the second row, and the fifth and sixth electrical contacts are arranged broadside-to-broadside so as to define a third broadside coupled differential signal pair.

2. The electrical connector of claim 1 further comprising a first non-air dielectric disposed between the first and second electrical contacts of the first pair of differential signal contacts and a second non-air dielectric disposed between the third and fourth electrical contacts of the second pair of differential signal contacts.

3. The electrical connector of claim 2, wherein at least one of the first or second non-air dielectrics include a plastic material.

4. The electrical connector of claim 2, wherein the first and second electrical contacts are housed in a first leadframe assembly and a second leadframe assembly, respectively, and wherein the first non-air dielectric is molded independent of the first and second leadframe assemblies.

5. The electrical connector of claim 1 further comprising:

a first ground contact disposed in the first column and in the second row adjacent the first electrical contact and the third electrical contact, and a second ground contact disposed in the second column and in the third row adjacent the third and fifth electrical contacts.

6. The electrical connector of claim 5, wherein a broadside of at least one of the first and second ground contacts is longer along the first direction than a broadside of at least one of the first and third electrical contacts.

7. The electrical connector of claim 1, wherein the first and third electrical contacts are arranged in a direction that defines an oblique angle with respect to the first column.

8. The electrical connector of claim 1, wherein the electrical connector is devoid of shields.

9. The electrical connector of claim 1, wherein the first electrical contact includes a first mating end and a first terminal end and defines a first contact length therebetween, wherein the second electrical contact includes a second mating end and a second terminal end and defines a second contact length therebetween, and wherein the first and second contact lengths are substantially equal.

10. The electrical connector of claim 1, wherein at least one of the first and second pairs of differential signal contacts has less than a −0.5 dB insertion loss up to a frequency of 20 GHz.

11. The electrical connector of claim 1, wherein at least one of the first and second differential signal pairs has approximately zero suck out in a range of 0 to 20 GHz.

12. An electrical connector comprising:

a first linear array of electrical contacts extending along a first direction, wherein the first linear array comprises a first electrical contact and an adjacent second electrical contact arranged broadside-to-broadside so as to form a first signal pair; and a second linear array of electrical contacts adjacent the first linear array and extending along the first direction, wherein the second linear array comprises a third electrical contact and an adjacent fourth electrical contact arranged broadside-to-broadside, wherein the third and fourth electrical contacts form a second signal pair, wherein the first and second signal pairs are offset from one another along the first direction, and wherein the second electrical contact and the third electrical contact are arranged edge-to-edge in a second direction substantially perpendicular to the first direction.

13. The electrical connector of claim 12 further comprising:

a first non-air dielectric disposed between the first and second electrical contacts; and a second non-air dielectric disposed between the third and fourth electrical contacts.

14. The electrical connector of claim 13, wherein the first and second electrical contacts are housed in a first leadframe assembly and a second leadframe assembly, respectively, and wherein the first non-air dielectric is formed as part of at least one of the first or second leadframe assemblies.

15. The electrical connector of claim 12 further comprising a ground contact adjacent the first electrical contact along the second direction and adjacent the third electrical contact along the first direction.

16. The electrical connector of claim 15, wherein the ground contact is arranged edge-to-edge with the first electrical contact, and wherein the ground contact is arranged broadside-to-broadside with the third electrical contact.

17. The electrical connector of claim 15, wherein a broadside of the ground contact is longer along the second direction than a broadside of at least one of the first and third electrical contacts.

18. The electrical connector of claim 12, wherein the electrical connector is devoid of shields.

19. The electrical connector of claim 12, wherein the first signal pair is a first differential signal pair, and the second pair is a second differential signal pair.

20. The electrical connector of claim 12, wherein at least one of the first or second differential signal pairs is configured to minimize signal skew.

21. An electrical connector comprising:

a first linear array of electrical contacts defining a first contact pattern along a first direction;

a second linear array of electrical contacts adjacent the first linear array, wherein the second linear array defines a second contact pattern along a second direction opposite the first direction, and wherein the first and second contact patterns are substantially the same;

a third linear array of electrical contacts adjacent the second linear array, wherein the third linear array defines a third contact pattern along the first or second direction, wherein when the third contact pattern is taken along the first direction, the third contact pattern is different from both the first and second contact patterns, and when the third contact pattern is taken along the second direction, the third contact pattern is different from both the first and second contact patterns; and wherein the each of the first, second, and third linear arrays comprises a ground contact and a signal contact.

22. The electrical connector of claim 21 further comprising an air dielectric surrounding a majority of each of the first, second and third linear arrays of electrical contacts.

* * * * *